US012808634B2

(12) United States Patent
Goldman et al.

(10) Patent No.: US 12,808,634 B2
(45) Date of Patent: Nov. 24, 2026

(54) MOUNTING APPARATUS FOR FIREARM-MOUNTED LIGHT

(71) Applicant: Coast Cutlery Co., Portland, OR (US)

(72) Inventors: David Goldman, Portland, OR (US); Chi Him Wong, Kowloon (HK); Ping Wang, Zhuhai (CN); Ensui Xie, Zhuhai (CN)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 19/440,515

(22) Filed: Jan. 5, 2026

(65) Prior Publication Data

US 2026/0210674 A1 Jul. 23, 2026

Related U.S. Application Data

(60) Provisional application No. 63/747,271, filed on Jan. 20, 2025.

(51) Int. Cl.
*F41G 11/00* (2006.01)
*F41C 27/00* (2006.01)

(52) U.S. Cl.
CPC ..... *F41G 11/003* (2013.01); *F41C 27/00* (2013.01)

(58) Field of Classification Search
CPC ..... F41G 11/003; F41C 27/00
See application file for complete search history.

(56) References Cited

U.S. PATENT DOCUMENTS

| | | | |
|---|---|---|---|
| 4,398,238 | A | 8/1983 | Nelson |
| 4,777,754 | A | 10/1988 | Reynolds, Jr. |
| 4,856,218 | A | 8/1989 | Reynolds, Jr. |
| 5,628,555 | A | 5/1997 | Sharrah et al. |
| 6,276,088 | B1 | 8/2001 | Matthews et al. |
| 6,345,464 | B1 | 2/2002 | Kim et al. |
| 6,378,237 | B1 | 4/2002 | Matthews et al. |
| 6,609,810 | B2 | 8/2003 | Kim |
| 6,622,416 | B2 | 9/2003 | Kim |
| 7,076,908 | B2 | 7/2006 | Kim |
| 7,117,624 | B2 | 10/2006 | Kim |
| 7,188,978 | B2 | 3/2007 | Sharrah et al. |
| D548,385 | S | 8/2007 | Sharrah et al. |
| 7,273,292 | B2 | 9/2007 | Kim |
| 7,310,903 | B2 | 12/2007 | Kim |
| 7,325,352 | B2 | 2/2008 | Matthews et al. |
| 7,332,682 | B2 | 2/2008 | Kim |
| 7,334,365 | B2 | 2/2008 | Kim |
| 7,334,366 | B2 | 2/2008 | La France |
| 7,360,333 | B2 | 4/2008 | Kim |
| 7,395,627 | B2 | 7/2008 | La France et al. |
| 7,421,817 | B2 | 9/2008 | Larsson |

(Continued)

*Primary Examiner* — Evan P Dzierzynski
(74) *Attorney, Agent, or Firm* — Schwabe, Williamson & Wyatt, P.C.

(57) ABSTRACT

Embodiments disclosed herein include a mounting apparatus for a firearm that is particularly suited for mounting an accessory to a rail of a firearm. The mounting apparatus includes an accessory body, a track on a surface of the accessory body, a keying element held in the track, and a keying element attached to the keying element. The keying element can be moved fore and aft and locked in place to adjust the position of the apparatus on the rail. Additionally, the thickness of the keying element can be augmented by a rotating selector to allow use with rail channels of different sizes.

14 Claims, 28 Drawing Sheets

(56) References Cited

U.S. PATENT DOCUMENTS

| | | | |
|---|---|---|---|
| 7,438,430 | B2 | 10/2008 | Kim |
| 7,441,918 | B2 | 10/2008 | Kim |
| 7,591,098 | B2 | 9/2009 | Matthews et al. |
| 7,614,760 | B2 | 11/2009 | Sharrah et al. |
| D612,970 | S | 3/2010 | Sharrah et al. |
| 7,712,242 | B2 | 5/2010 | Matthews et al. |
| 7,941,960 | B2 | 5/2011 | Matthews et al. |
| 8,127,484 | B2 | 3/2012 | Matthews et al. |
| 8,182,109 | B2 | 5/2012 | Matthews et al. |
| D674,525 | S | 1/2013 | Sharrah et al. |
| 8,371,729 | B2 | 2/2013 | Sharrah et al. |
| 8,613,534 | B2 | 12/2013 | Jigamian et al. |
| D712,001 | S | 8/2014 | Wells |
| 8,936,380 | B2 | 1/2015 | Jigamian |
| 8,944,626 | B2 | 2/2015 | Matthews et al. |
| 9,004,729 | B2 | 4/2015 | Jigamian |
| 9,228,804 | B2 | 1/2016 | Syrengelas et al. |
| 9,423,102 | B2 | 8/2016 | Jigamian et al. |
| 9,551,550 | B2 | 1/2017 | Wells |
| D781,983 | S | 3/2017 | Wells |
| D796,622 | S | 9/2017 | Sharrah |
| 9,772,163 | B2 | 9/2017 | Sharrah et al. |
| 9,784,435 | B2 | 10/2017 | Jigamian et al. |
| 10,001,342 | B2 | 6/2018 | Sharrah et al. |
| 10,295,128 | B2 | 5/2019 | Sharrah et al. |
| 10,344,959 | B2 | 7/2019 | Worman et al. |
| D857,268 | S | 8/2019 | Worman |
| D857,960 | S | 8/2019 | Worman |
| 10,612,732 | B2 | 4/2020 | Sharrah et al. |
| 10,612,761 | B1 | 4/2020 | Worman et al. |
| D885,510 | S | 5/2020 | Wells et al. |
| 10,670,251 | B1 | 6/2020 | Hawk et al. |
| 10,697,623 | B2 | 6/2020 | Worman et al. |
| D898,260 | S | 10/2020 | Worman |
| D898,261 | S | 10/2020 | Worman |
| D907,267 | S | 1/2021 | Worman |
| D907,268 | S | 1/2021 | Worman |
| D907,269 | S | 1/2021 | Worman |
| D907,270 | S | 1/2021 | Worman |
| 10,928,061 | B2 | 2/2021 | Rasi et al. |
| D913,553 | S | 3/2021 | Worman |
| D913,554 | S | 3/2021 | Worman |
| 10,948,266 | B2 | 3/2021 | Wells et al. |
| D919,149 | S | 5/2021 | Worman |
| D919,150 | S | 5/2021 | Worman |
| 11,092,323 | B2 | 8/2021 | Hawk et al. |
| 11,162,665 | B2 | 11/2021 | Worman |
| 11,181,258 | B2 | 11/2021 | Worman |
| 11,506,366 | B2 | 11/2022 | Sharrah et al. |
| D997,285 | S | 8/2023 | Worman |
| D997,413 | S | 8/2023 | Sharrah et al. |
| D999,624 | S | 9/2023 | Sharrah et al. |
| D1,005,541 | S | 11/2023 | Worman |
| D1,013,501 | S | 2/2024 | Sharrah et al. |
| 2005/0079746 | A1 | 4/2005 | Seith et al. |
| 2008/0168696 | A1 | 7/2008 | Orne et al. |
| 2009/0091925 | A1 | 4/2009 | Hesse et al. |
| 2011/0076095 | A1* | 3/2011 | Storch ..... F41G 11/003 403/322.4 |
| 2011/0080736 | A1 | 4/2011 | Brands et al. |
| 2012/0268920 | A1 | 10/2012 | Matthews et al. |
| 2014/0305021 | A1* | 10/2014 | Prieto ..... F41G 11/003 42/111 |
| 2016/0102947 | A1* | 4/2016 | Visinski ..... F41C 27/00 42/90 |
| 2019/0301835 | A1* | 10/2019 | Tayon ..... F41G 1/35 |
| 2020/0103094 | A1 | 4/2020 | Stevenson et al. |
| 2020/0200508 | A1 | 6/2020 | Teetzel et al. |
| 2020/0240750 | A1 | 7/2020 | Reed et al. |
| 2021/0337679 | A1 | 10/2021 | Roth |
| 2022/0082215 | A1 | 3/2022 | Jones |
| 2023/0160664 | A1* | 5/2023 | Stern ..... F41G 11/003 42/90 |
| 2023/0175812 | A1* | 6/2023 | Faifer ..... F41C 33/0245 224/678 |
| 2023/0184517 | A1 | 6/2023 | Davis et al. |
| 2023/0288159 | A1 | 9/2023 | Kastrun et al. |
| 2024/0110758 | A1 | 4/2024 | Roe et al. |
| 2024/0142201 | A1 | 5/2024 | Kilgore |

* cited by examiner

MOUNTING APPARATUS FOR FIREARM-MOUNTED LIGHT

PRIORITY CLAIM

This application claims the benefit of U.S. provisional patent application no. 63/747,271, filed Jan. 20, 2025, titled "Mounting Apparatus For Firearm-Mounted Light," which is incorporated herein by reference.

TECHNICAL FIELD

Embodiments herein relate to a mounting apparatus for a light that is particularly suited for mounting an accessory to a rail of a firearm.

BACKGROUND

Many firearms such as handguns have an integrated rail, e.g., a Picatinny or Weaver style rail, to allow mounting of accessories such as a light. The accessory can be mounted under a barrel of the handgun, for instance. A firearm-mounted light is useful in many situations such as for home defense to allow identification of a threat in a low light scenario. However, various challenges are encountered in mounting the accessories.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
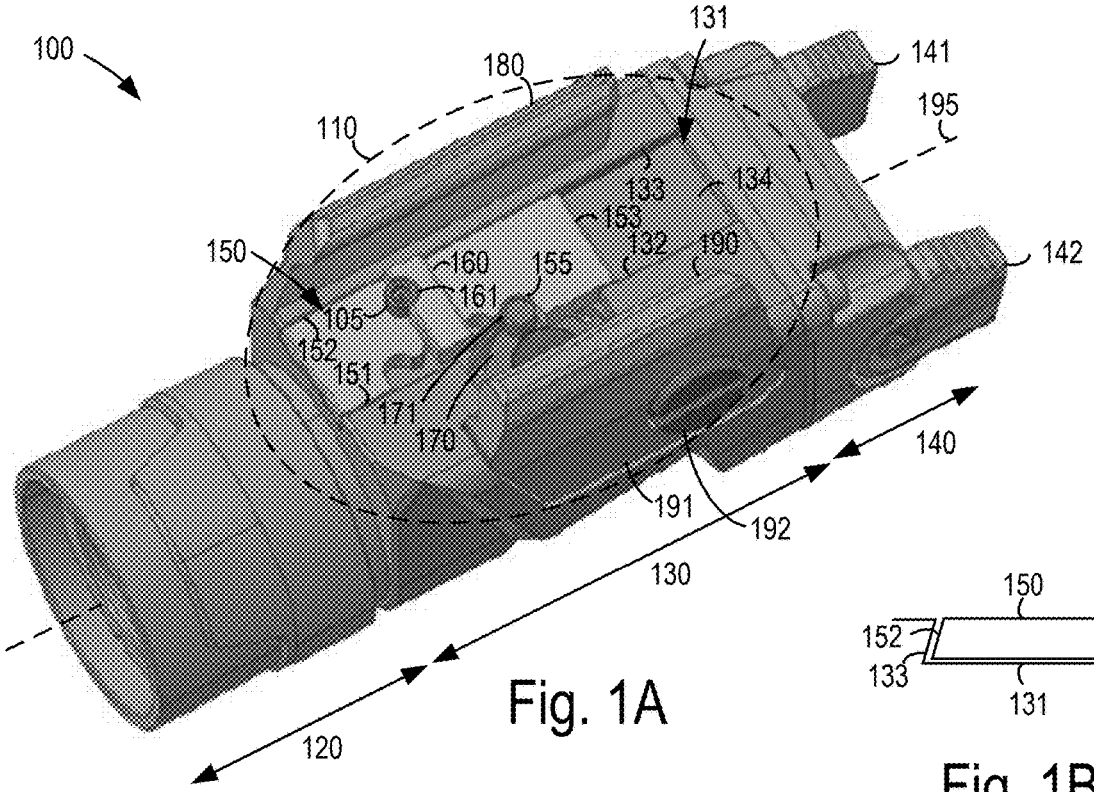
FIG. 1A depicts a top view of an example light assembly 100 that includes an accessory body 130 having an adjustable rail mount 110, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

As mentioned at the outset, various challenges are presented in mounting an accessory such as a light to a firearm.

A firearm may include a rail mount (a rail) that is used to secure an accessory onto the firearm. The accessory can be mounted below the barrel and in front of the trigger guard, in one approach. In another approach, the accessory is mounted on the top side of the firearm. The accessory could be an incandescent light, light-emitting diode (LED) light, laser light, camera, night-vision device, range-finder or scope, for example.

Some handguns have a rail under the barrel, for instance, to hold an accessory. The rail can be provided according to a standard such as MIL-STD-1913 which is also known as a Picatinny rail in reference to the Picatinny Arsenal of the U.S. Army in New Jersey, or according to a manufacturer-specific design.

The mounting system should hold the accessory securely, and allow for easy installation, adjustment and removal of the accessory.

The solutions provided herein address the above and other issues.

In one aspect, a mounting apparatus is provided that allows for easy installation, adjustment and removal of a firearm-mounted accessory. The mounting apparatus is compatible with firearms that include rails with one or more channels, and with channels of different sizes. The mounting apparatus allows for fore and aft adjustment of the position of the accessory along the rail to provide compatibility with different firearms and to customize the position to the user's preference. The mounting apparatus can be locked in place in one of multiple available positions. The mounting apparatus can provide a tactile and/or audible feedback of movement of the apparatus between the different positions.

The above and other features will be apparent from the following detailed discussion.

FIG. 1A depicts a top view of an example light assembly 100 (or light accessory) that includes an accessory body 130 having an adjustable rail mount 110, in accordance with various embodiments. While a light accessory is discussed in this example, other types of firearm-mounted accessories can be used, as mentioned. Also, the light accessory can be mounted to an object other than a firearm. A front of the body is attached to an optic 120 such as a lens, and the rear of the body (tail cap assembly 140) includes one or more switches 141 and 142 to activate the light. The body may house other components such as a light source and one or more batteries for powering the light source.

The adjustable rail mount 110 is provided at the top of the body in this example to allow mounting to the underside of a rail, such as under the barrel of a handgun. Although, other configurations are possible. For example, the adjustable rail mount 110 could be at the bottom of the body to allow mounting to the top side of a rail of a firearm such as a handgun or rifle, shotgun or other long gun, or to another object.

Generally, the adjustable rail mount can be used to secure the light onto a firearm such as a pistol below the barrel and in front of the trigger guard. An adjustable, keying element 150 can move fore and aft within a dovetailed track 131 (or slot), that includes a floor 134 and opposing walls 132 and 133. The track extends in an axial direction of the accessory body, parallel to the longitudinal axis 195 of the accessory. A transverse direction is transverse to the axial direction. The keying element 150 may have a generally rectangular shape when viewed from above, with the exception of notches on one side of the keying element. The keying element 150 may have a portion 153 with a first height, and a keying member 160 or portion with a greater second height. See also FIG. 7C. The keying member 160 can be attached to, or integral with the keying element portion 153.

The keying element is non-removable from the body, in an example implementation, to prevent it from being lost by the user. The keying element can lock into position to fit industry-standard rails, for instance, to set the distance from the trigger guard. This allows the light assembly to be compatible with different firearms as well as to customize the position of the light assembly relative to the trigger and the barrel of the firearm.

The keying member 160 of the keying element is configured to engage a channel in the mounting rail of the firearm. See FIGS. 16A and 16B. The channel may extend transversely to the axial direction. The keying element includes a cutout 161 for a screw 105 that helps to accommodate a proper fit in rails that have different channel widths. The screw can be removed to allow the keying member 160 to fit a smaller channel width, or installed to allow the keying member 160, together with the screw, to fit a larger channel width, on the rail of a firearm. Different screw head diameters could be used to fit different channel widths, where the screw head diameter can be as large as allowed by the cutout 161, or smaller. The cutout may be arcuate, for example.

A removable rail clamp 191 can be used to secure the light assembly 100 to the rail, and simultaneously prevent the keying element 150 from changing positions in the track 131 via a position lock 170. The rail clamp 191 can be tightened using a thumb screw 192 or a flat tool or coin. When the rail clamp 191 is tightened, the clamping member 190 (or arm) of the rail clamp moves closer to the opposing clamping member 180 (or arm) to tighten the body to a firearm rail. The clamping members 180 and 190 are first and second clamping members, respectively. Additionally, the position lock 170 has a pawl 171 that engages one notch among a set of notches 155-158 (FIG. 7B) at a first edge 151 of the keying element 150. The opposing first and second edges 151 and 152, respectively, of the keying element 150 are adjacent to the walls 132 and 133, respectively.

FIG. 1A shows the first clamping member 180 being integral with the accessory body while the rail clamp 191 and its second clamping member 190 are attachable to (and optionally removable from) the accessory body, e.g., by the screw 192. In another implementation, both the first and second clamping members are attachable to the accessory body, e.g., by respective screws. Also, FIG. 1A shows the removable clamping member as being on the left side of the accessory, looking forward (frontward) in the direction in which the firearm points. The backward or rearward direction is the opposite direction. In another option, the configuration is reversed so that the removable clamping member is on the right side of the accessory.

Figure 1B:
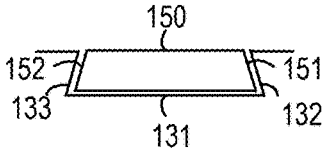
FIG. 1B depicts a cross-sectional view of the keying element 150 and the track 131 of FIG. 1A, in accordance with various embodiments.

FIG. 1B depicts a cross-sectional view of the keying element 150 and the track 131 of FIG. 1A, in accordance with various embodiments. The track has a dovetailed shape with opposing sloped side walls 132 and 133 to retain the keying element 150, which may also have opposing sloped edges 151 and 152.

Figure 2:
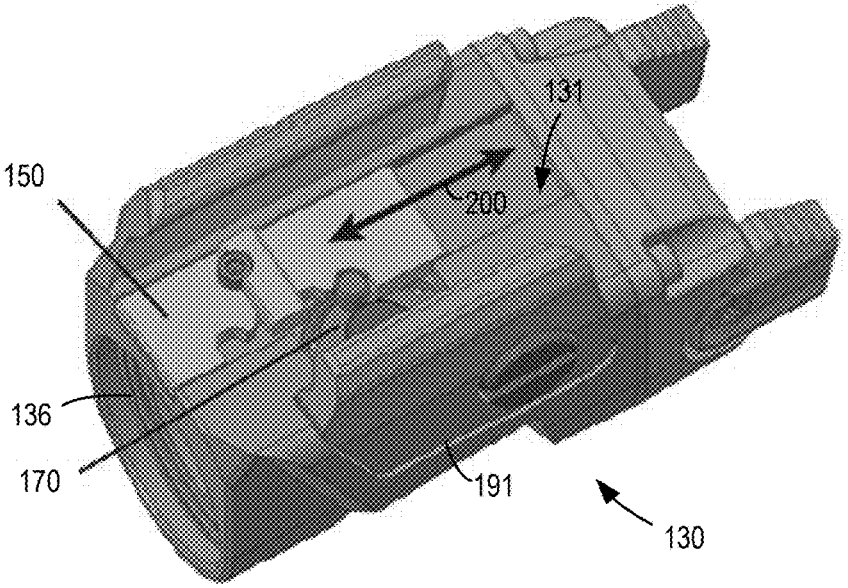
FIG. 2 depicts a top view of the accessory body 130 of FIG. 1A, in accordance with various embodiments.

FIG. 2 depicts a top view of the accessory body 130 of FIG. 1A, in accordance with various embodiments. The arrow 200 indicates a direction of movement of the keying element 150 within the track 131. The position lock 170 and rail clamp 191 are also shown. The front of the body may have a threaded region 136 to attach to a threaded region at the rear of the optic 120.

Figure 3:
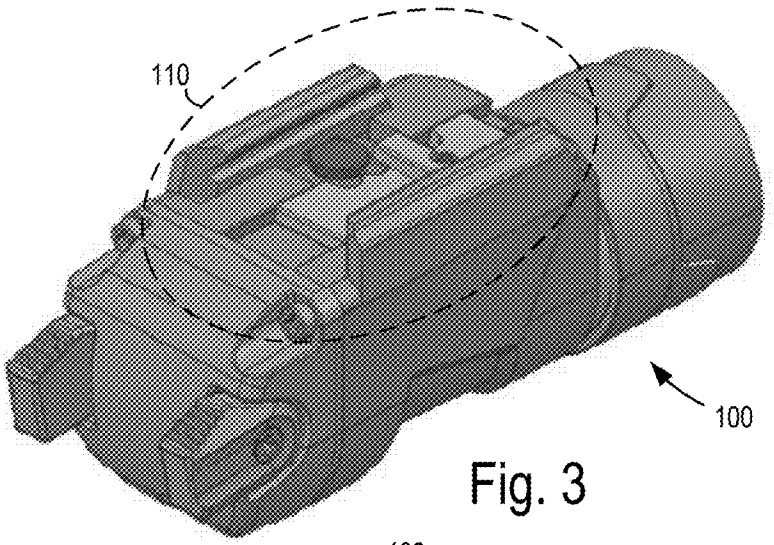
FIG. 3 depicts a rear view of the light assembly 100 of FIG. 1A, in accordance with various embodiments.

FIG. 3 depicts a rear view of the light assembly 100 of FIG. 1A, in accordance with various embodiments. The adjustable rail mount 110 is depicted in this rear view.

Figure 4:
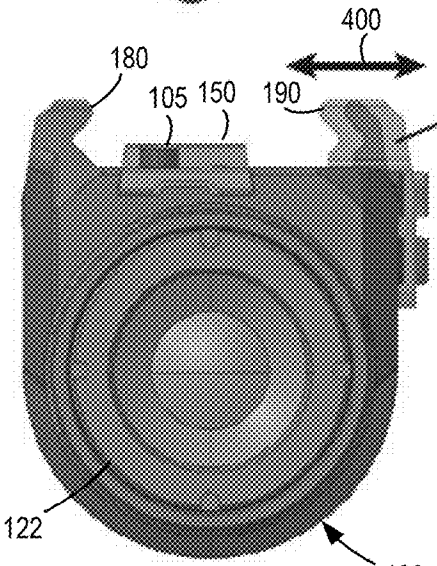
FIG. 4 depicts a front view of the light assembly 100 of FIG. 1A, where an arrow 400 shows lateral movement of the rail clamp 191 to the left or right as it is attached or removed, respectively, in accordance with various embodiments.

FIG. 4 depicts a front view of the light assembly 100 of FIG. 1A, where an arrow 400 shows lateral movement of the rail clamp 191 to the left or right as it is attached or removed, respectively, in accordance with various embodiments. As mentioned, the rail clamp can be attached to the body by tightening the clamp screw 192 and removed from the body by untightening the clamp screw. A lens 122 of the optic 120 is also depicted.

Figure 5:
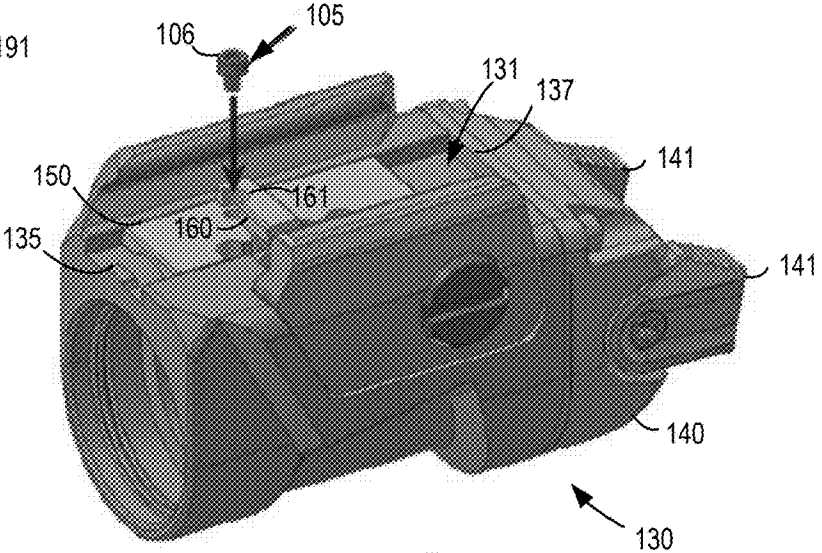
FIG. 5 depicts the accessory body 130 of FIG. 1A, showing the accommodation screw 105 being added to the keying element 150, in accordance with various embodiments.

FIG. 5 depicts the accessory body 130 of FIG. 1A, showing the accommodation screw 105 being added to the keying element 150, in accordance with various embodiments. As mentioned, the screw can be removed to fit a smaller channel width or installed to fit a larger channel width, on the rail of a firearm. See also FIGS. 16A and 16B and the channel width w of the example rail 1310. The head 106 of the accommodation screw 105 protrudes from the keying member 160 in the axial direction, and is partially encompassed within the cutout 161 of the keying element.

The accessory body 130 is attached to the tail cap assembly 140. The track 131 includes a front stop 135 and a rear stop 137 that is provided by a front edge of the tail cap assembly 140 to retain the keying element 150.

Figure 6:
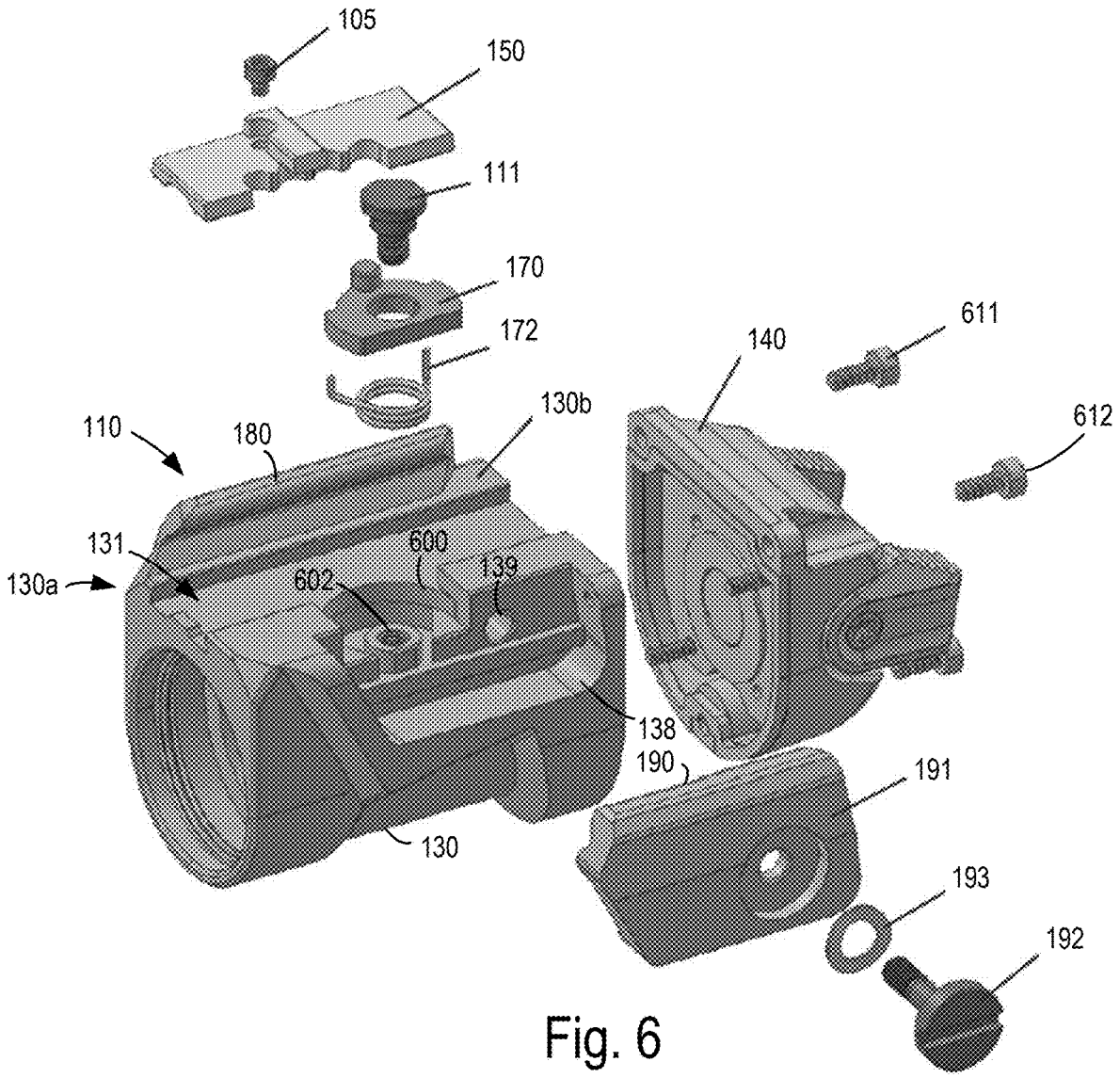
FIG. 6 depicts an exploded view of the accessory body 130 and its adjustable rail mount 110, consistent with FIG. 1A, in accordance with various embodiments.

FIG. 6 depicts an exploded view of the accessory body 130 and its adjustable rail mount 110, consistent with FIG. 1A, in accordance with various embodiments. The accessory body 130 includes a cutout region 138 in which the rail clamp 191 is inserted. The screw 192 is inserted via a washer 193 into a hole in the rail clamp 191 and engages a threaded hole 139 in the accessory body 130. A top side 130*a* of the accessory body 130 includes a cutout region 600 to hold the position lock 170 and a spring 172. A screw 111 is inserted into a threaded hole 602 in the accessory body to secure the position lock 170 and the spring 172 to the top side. The position lock 170 and a spring 172 can rotate together about an axis of the screw 111 within a limited angular range. The position lock is rotatable and biased by the spring. The rotatable position lock 170 is rotatable in a first direction, e.g., clockwise when viewed from above, when the keying element is moved aft in the track and rotatable in a second direction, opposite the first direction, e.g., counterclockwise, when the keying element is moved forward in the track.

The clamping member 180 extends from the top side 130*a*, along a portion of the longitudinal axis of the accessory body 130, and is adjacent to a flat surface 130*b* along a remaining portion of the longitudinal axis, in this example. In another example, the clamping member 180 extends along an entirety of the longitudinal axis of the accessory body 130.

The tail cap assembly 140 can be attached to the accessory body 130 by screws 611 and 612.

The body and adjustable rail mount can include components made of appropriate materials such as metal or plastic.

Figure 7A:
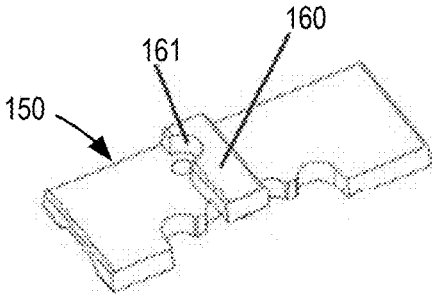
FIG. 7A depicts a top side view of the keying element 150 of FIG. 1A, in accordance with various embodiments.

FIG. 7A depicts a top side view of the keying element 150 of FIG. 1A, in accordance with various embodiments. The keying member 160 and cutout 161 are depicted.

Figure 7B:
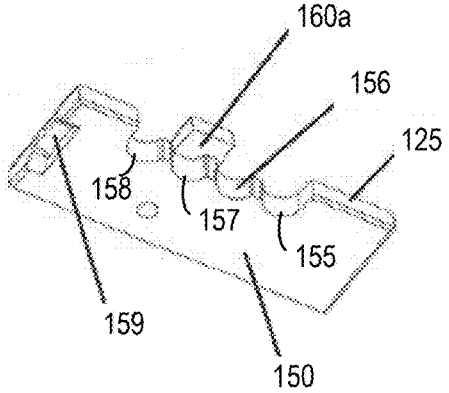
FIG. 7B depicts a bottom side view of the keying element 150 of FIG. 7A, in accordance with various embodiments.

FIG. 7B depicts a bottom side view of the keying element 150 of FIG. 7A, in accordance with various embodiments. The first, second, third and fourth notches 155, 156, 157 and 158, respectively, of the keying element 150 are depicted. The A portion 160*a* of the keying member 160 overhangs a side of the keying element 150. A cutout 159 may engage the front stop 135 of FIG. 5 when the keying element 150 is in its frontmost position.

The sides of the keying element, such as the example side 125, may be tapered to allow it to slide along a dovetailed track 131 in the accessory body 130. See also FIG. 1B.

Figure 7C:
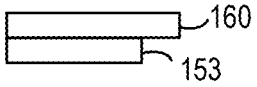
FIG. 7C depicts a cross-sectional view of the portion 153 of the keying element 150 and the keying member 160, in accordance with various embodiments.

FIG. 7C depicts a cross-sectional view of the portion 153 of the keying element 150 and the keying member 160, in accordance with various embodiments. A height of the keying member 160 may correspond to the depth of a channel in a rail of a firearm. The keying member 160 is shaped and sized to correspond to a channel of a rail of a firearm. The keying member 160 may have a rectangular cross-section when viewed from the front or side of the accessory body 130.

Figure 8:
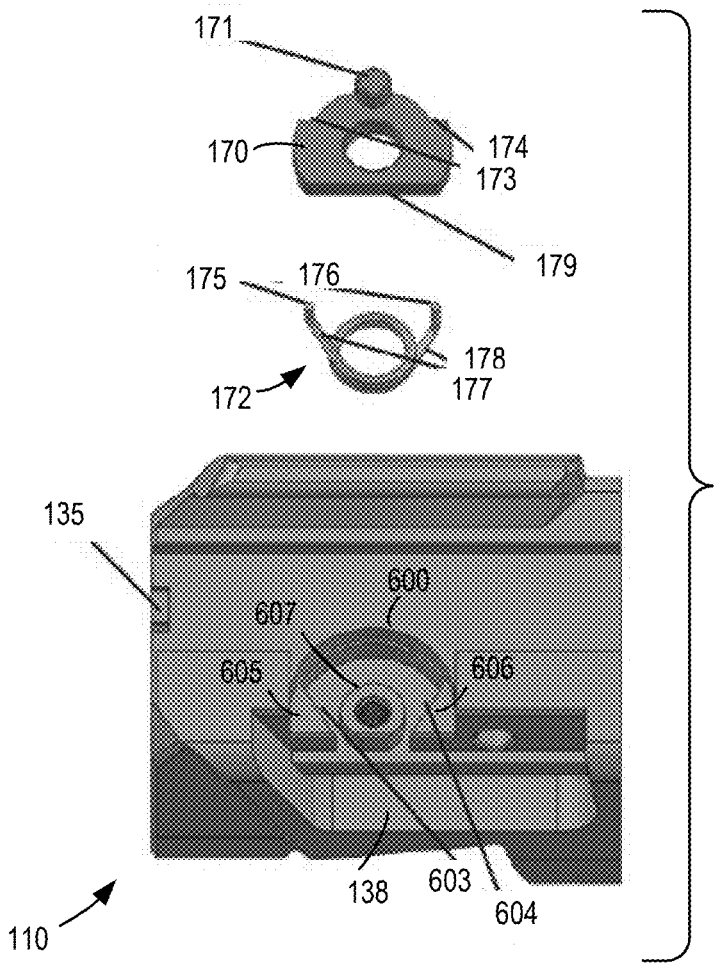
FIG. 8 depicts an exploded top view of a portion of the adjustable rail mount 110 of FIG. 1A, in accordance with various embodiments.

FIG. 8 depicts an exploded top view of a portion of the adjustable rail mount 110 of FIG. 1A, in accordance with various embodiments. The spring 172 can be seated in the cutout region 600. The spring can include a coil with arms 177 and 178 with respective tips 175 and 176. The arms 177 and 178 apply pressure to inner walls 603 and 604, respectively, of the cutout region 600. The tips 175 and 176 are seated in notches 173 and 174, respectively, of the position lock 170. A bottom of the position lock 170 rests on top surfaces 605, 606 and 607 of the adjustable rail mount 110.

The position lock 170 can rotate against the force of the spring clockwise or counterclockwise when the keying element 150 moves aft and fore, respectively, within the track 131. The position lock rotates to allow the pawl 171 to engage the next notch in the keying element.

Figure 9:
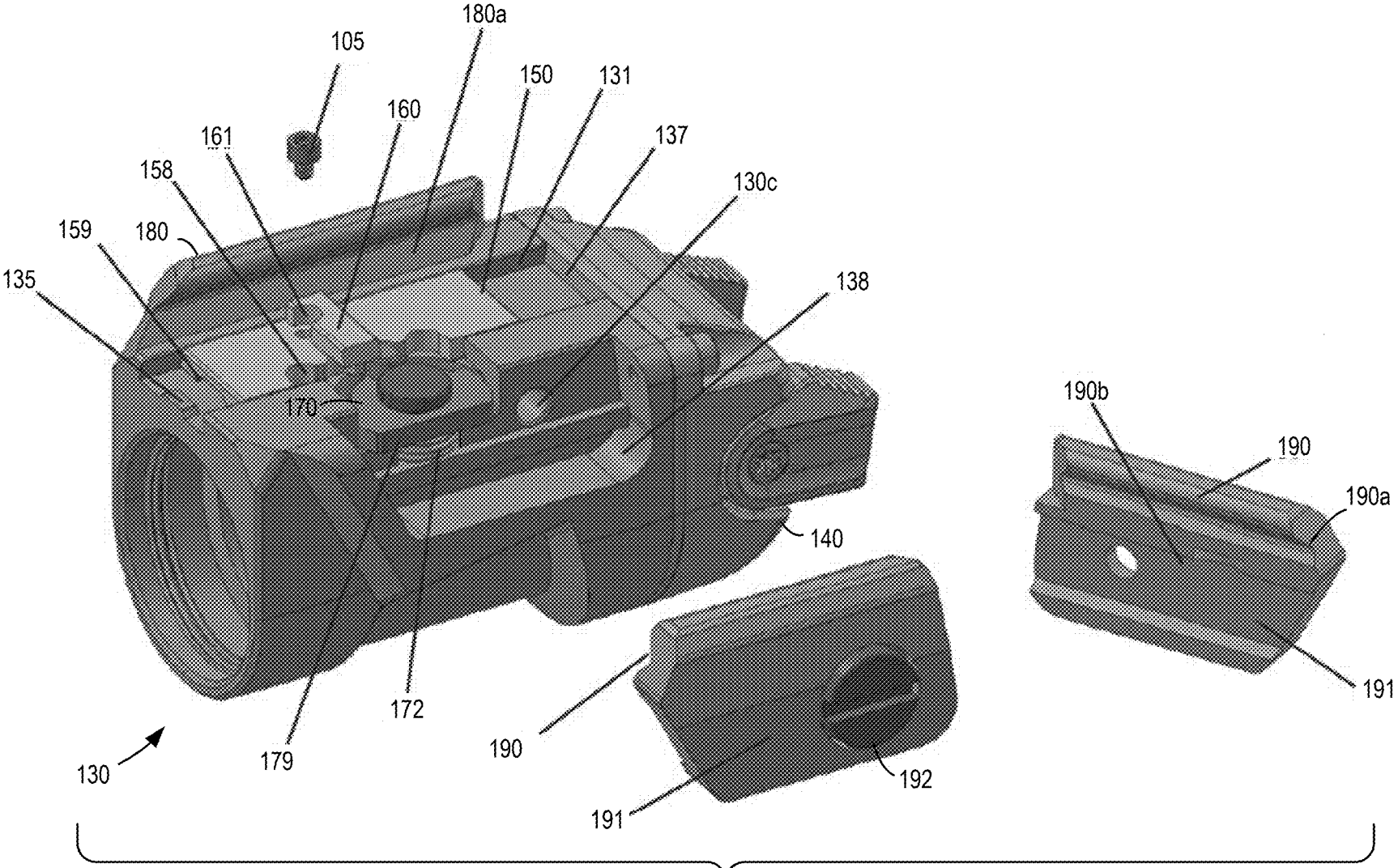
FIG. 9 depicts the accessory body 130 of FIG. 1A including front and rear sides of the rail clamp 191, in accordance with various embodiments.

FIG. 9 depicts the accessory body 130 of FIG. 1A including front and rear sides of the rail clamp 191, in accordance with various embodiments. The position lock 170 and spring 172 are depicted.

As mentioned, the accessory body 130 can be secured to a firearm by an adjustable rail mount that includes the clamping member 180 on the accessory body 130 and the removable rail clamp 191 with the clamping member 190. The position and alignment of the body against the firearm is determined by the position of the keying element 150 in the track.

The keying element 150 can shift position in relation to the accessory body 130 and the position lock 170 acts as a detent to hold the keying element in place. When the clamp screw 192 is tightened, the inside wall 190*b* of the rail clamp 191 presses against the flat face 179 of the position lock 170, preventing the position lock from rotating. The accessory body has the cutout region 138 that accommodates the rail clamp, as mentioned.

The pawl 171 of the position lock 170 presses into one notch of a plurality of notches 155-158 (FIG. 7B) in the keying element, locking the keying element in place and preventing it from sliding against the accessory body 130. When aligned with a channel of the rail of a firearm, the keying member 160 of the keying element 150 will sit in the channel and the position of the keying element 150 will determine the location at which the accessory is clamped to the firearm. Tightening of the clamp screw 192 will allow the rail to be clamped between the clamping member 180 of the accessory body (at an inset region 180*a*) and the clamping member 190 of the rail clamp 191 (at an inset region 190*a*).

The clamp screw 192 enters the accessory body 130 via an aperture 130*c* from the same side as the rail clamp 191 and does not protrude out from the other side, in one approach. To account for variations among channel widths of different firearm rails, the removable accommodation screw 105 can be added or removed from the keying element 150 as needed.

When the clamp screw 192 is loosened, the rail clamp 191 relieves pressure from the position lock 170. When in the unlocked position, the position lock 170 will resist rotation by means of the lock spring 172 that applies pressure to inner walls 603 and 604 of the accessory body 130 and notches 173 and 174 on the position lock 170. When in the unlocked position, the keying element 150 can be slid with light effort by the user to force the pawl 171 of the position lock 170 out from one of the notches of the keying element 150 in either direction and into another of the notches. The position lock 170 may snap into each notch under the force of the spring creating a tactile and audible feedback, e.g., a click. This can assist the user in ensuring that the keying element and the accessory body are properly seated against the firearm rail.

In one approach, the keying element 150 is prevented from being removed from the accessory body by a stop 135 on one end of the track and the tail cap assembly 140 on the other end. The tail cap assembly 140 can be affixed to the accessory body 130 and is not user-serviceable, in one approach. Removal of the keying element 150 from the accessory body product may also be prevented in other ways, such as by elements of the optic or a tail cap that opens.

Figure 10A:
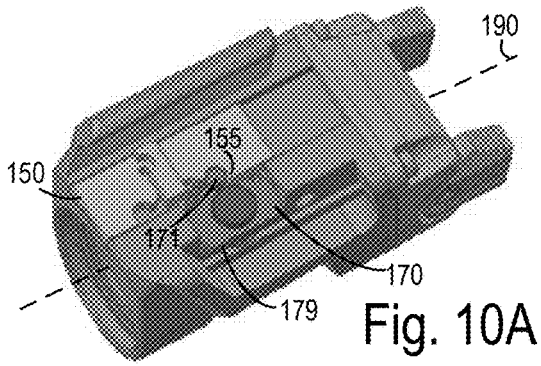
FIG. 10A depicts a top view of the accessory body 130 of FIG. 1A, where a pawl 171 of the position lock 170 engages a first notch 155 of the keying element 150, in accordance with various embodiments.

FIG. 10A depicts a top view of the accessory body 130 of FIG. 1A, where a pawl 171 of the position lock 170 engages a first notch 155 of the keying element 150, in accordance with various embodiments. The flat face 179 of the position lock 170 is generally parallel to the longitudinal axis 195 of the accessory. The keying element is in its frontmost position on the body, and the accessory body is in its rearmost position relative to the channel, in this configuration.

Figure 10B:
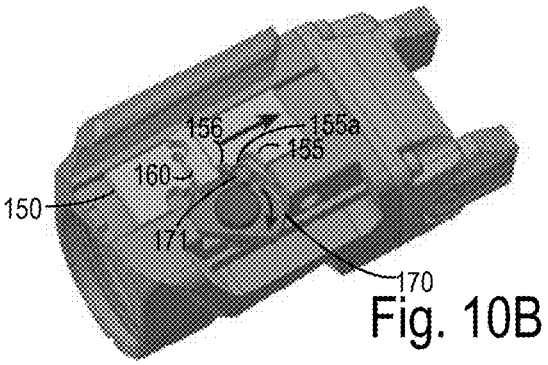
FIG. 10B depicts a top view of the accessory body 130 of FIG. 1A, where the pawl 171 of the position lock 170 is between first and second notches 155 and 156, respectively, of the keying element 150, in accordance with various embodiments.

FIG. 10B depicts a top view of the accessory body 130 of FIG. 1A, where the pawl 171 of the position lock 170 is between first and second notches 155 and 156, respectively, of the keying element 150, in accordance with various embodiments. In particular, the position lock 170 rotates clockwise and the pawl 171 moves from the first notch 155 to an edge surface 155*a* of the keying element, when the body is moved forward relative to the rail and the firearm so that the keying element moves rearward relative to the body in the direction of the arrow. The pawl may snap back from the edge surface 155*a* to the notch 156 as the accessory body is moved. In one approach, as the user moves the accessory body fore or aft along the rail, the keying element 150 is locked in place in the body based on the notch that the pawl engages.

Figure 10C:
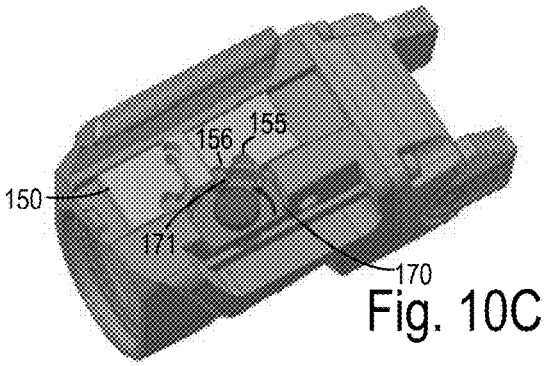
FIG. 10C depicts a top view of the accessory body 130 of FIG. 1A, where the pawl 171 of the position lock 170 engages a second notch 156 of the keying element 150, in accordance with various embodiments.

FIG. 10C depicts a top view of the accessory body 130 of FIG. 1A, where the pawl 171 of the position lock 170 engages a second notch 156 of the keying element 150, in accordance with various embodiments. Once the accessory body moves sufficiently forward relative to the channel, the pawl transitions from the edge surface 155*a* to the notch 156 as the position lock 170 rotates counterclockwise.

Figure 10D:
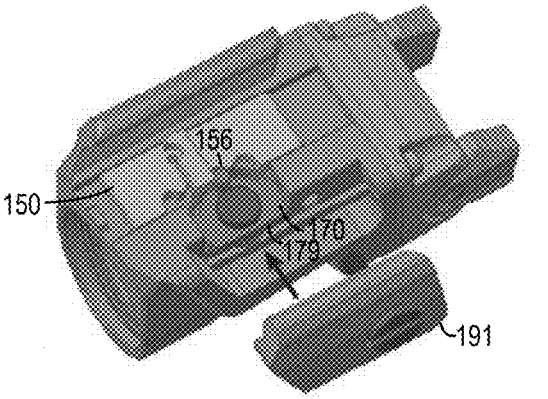
FIG. 10D depicts a top view of the accessory body 130 of FIG. 10C, showing movement of the rail clamp 191 into a position adjacent to the flat face 179 of the position lock 170, in accordance with various embodiments.

FIG. 10D depicts a top view of the accessory body 130 of FIG. 10C, showing movement of the rail clamp 191 into a position adjacent to the flat face 179 of the position lock 170, in accordance with various embodiments. In this case, the current location of the accessory body relative to the rail is the location desired by the user, so the user installs the rail clamp 191 to the accessory body to lock the accessory body in that location. The inside wall 190*b* (FIG. 9) of the rail clamp 191 may press against the flat face 179 of the position lock 170, or otherwise be adjacent to the flat face 179 of the position lock 170, preventing the position lock from rotating out of its neutral position. This prevents the keying element from moving, to thereby prevent the accessory body from moving.

Figure 11A:
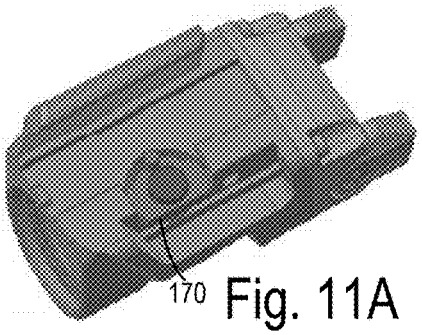
FIG. 11A depicts a top view of the accessory body 130 of FIG. 10A without the keying element 150, where the position lock 170 is in a neutral or central position, in accordance with various embodiments.

FIG. 11A depicts a top view of the accessory body 130 of FIG. 10A without the keying element 150, where the position lock 170 is in a neutral or central position, in accordance with various embodiments.

Figure 11B:
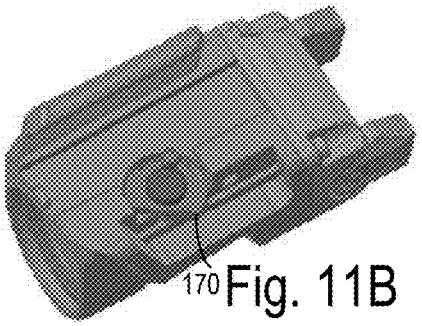
FIG. 11B depicts a top view of the accessory body 130 of FIG. 10B without the keying element 150, where the position lock 170 is rotated clockwise relative to the neutral position, in accordance with various embodiments.

FIG. 11B depicts a top view of the accessory body 130 of FIG. 10B without the keying element 150, where the position lock 170 is rotated clockwise relative to the neutral position, in accordance with various embodiments.

Figure 11C:
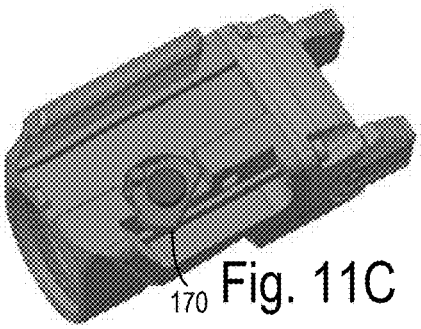
FIG. 11C depicts a top view of the accessory body 130 similar to FIG. 11B, but where the position lock 170 is rotated counterclockwise relative to the neutral position, in accordance with various embodiments.

FIG. 11C depicts a top view of the accessory body 130 similar to FIG. 11B, but where the position lock 170 is rotated counterclockwise relative to the neutral position, in accordance with various embodiments.

Figure 11D:
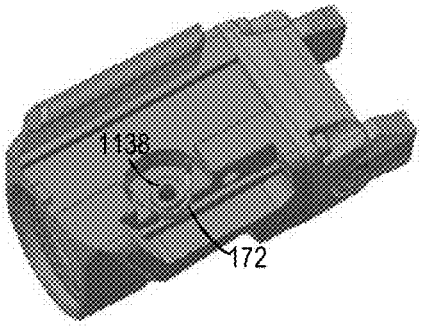
FIG. 11D depicts a top view of the accessory body 130 of FIG. 10C, showing a coil of the lock spring 172 installed around a cylinder 1138 of the accessory body 130, in accordance with various embodiments.

FIG. 11D depicts a top view of the accessory body 130 of FIG. 10C, showing a coil of the lock spring 172 installed around a cylinder 38 of the accessory body 130, in accordance with various embodiments.

Figure 12A:
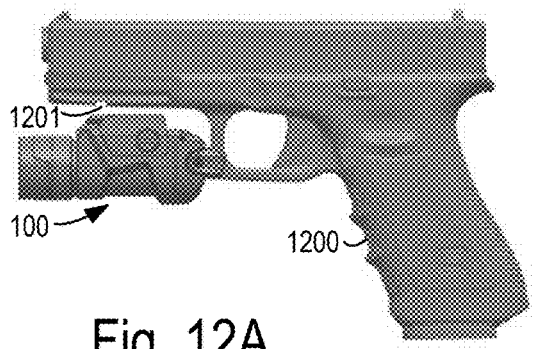
FIG. 12A depicts the light assembly 100 of FIG. 1A detached from an example Glock® firearm 1200 having a Glock®-style rail with a single channel 1201, in accordance with various embodiments.

FIG. 12A depicts the light assembly 100 of FIG. 1A detached from an example Glock® firearm 1200 having a Glock®-style rail with a single channel 1201, in accordance with various embodiments. As mentioned, the firearm accessory described herein is compatible with many different firearm mounting rails. Some rails are standardized in the industry while other are company-specific, such as the Glock®-style rail that is specific to Glock Ges.m.b.H., Deutsch-Wagram, Austria. As mentioned, the keying member 160 of the keying element engages the channel 1201 in the mounting rail of the firearm. See also FIGS. 16A and 16B.

Figure 12B:
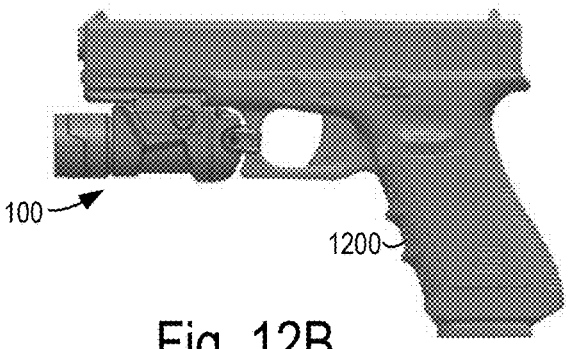
FIG. 12B depicts the light assembly 100 attached to the firearm 1200 of FIG. 12A, in accordance with various embodiments.

FIG. 12B depicts the light assembly 100 attached to the firearm 1200 of FIG. 12A, in accordance with various embodiments.

Figure 13A:
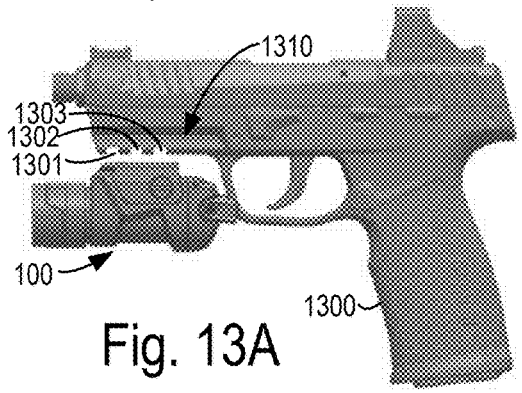
FIG. 13A depicts the light assembly 100 of FIG. 1A detached from an example Sig Sauer® firearm 1300 having an M1913-style Picatinny rail 1310 with channels 1301, 1302 and 1303, in accordance with various embodiments.

FIG. 13A depicts the light assembly 100 of FIG. 1A detached from an example Sig Sauer® firearm 1300 having an M1913-style Picatinny rail 1310 with channels 1301, 1302 and 1303, in accordance with various embodiments. The M1913-style Picatinny rail is an industry standard rail and includes three channels in this example. The number of channels can vary with this standard.

Figure 13B:
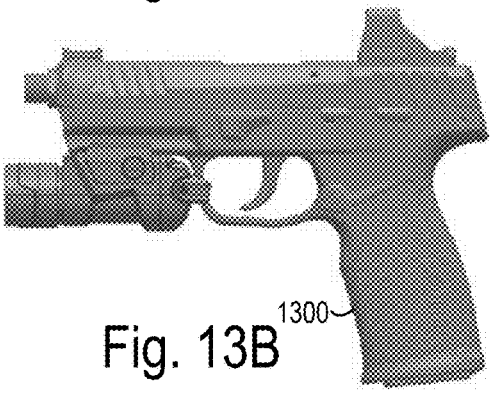
FIG. 13B depicts the light assembly 100 attached to the firearm 1300 of FIG. 13A, in accordance with various embodiments.

FIG. 13B depicts the light assembly 100 attached to the firearm 1300 of FIG. 13A, in accordance with various embodiments.

Figure 14A:
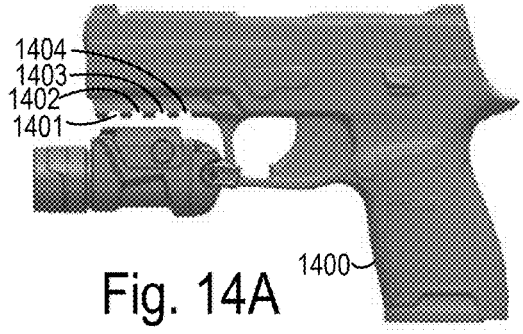
FIG. 14A depicts the light assembly 100 of FIG. 1A detached from an example Sig Sauer® firearm 1400 with channels 1401, 1402, 1403 and 1404, in accordance with various embodiments.

FIG. 14A depicts the light assembly 100 of FIG. 1A detached from an example Sig Sauer® firearm 1400 with channels 1401, 1402, 1403 and 1404, in accordance with various embodiments. Four channels are available in this example to position the keying member 160 of the keying element.

Figure 14B:
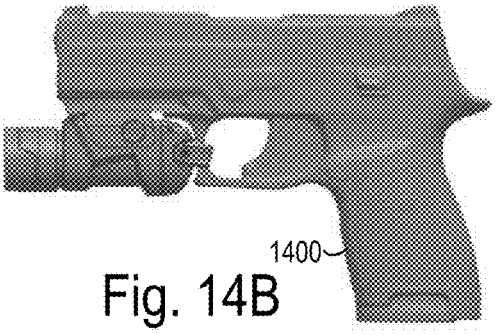
FIG. 14B depicts the light assembly 100 attached to the firearm 1400 of FIG. 14A, in accordance with various embodiments.

FIG. 14B depicts the light assembly 100 attached to the firearm 1400 of FIG. 14A, in accordance with various embodiments.

Figure 15A:
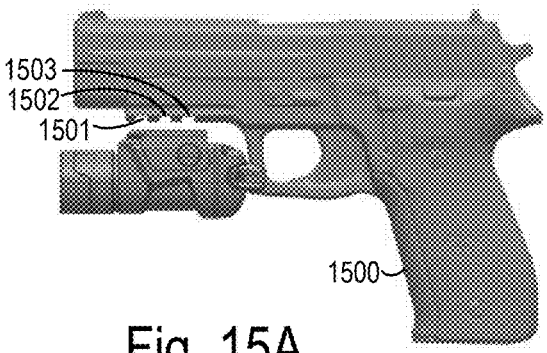
FIG. 15A depicts the light assembly 100 of FIG. 1A detached from an example Sig Sauer® P226 firearm 1500 with channels 1501, 1502 and 1503, in accordance with various embodiments.

FIG. 15A depicts the light assembly 100 of FIG. 1A detached from an example Sig Sauer® P226 firearm 1500 with channels 1501, 1502 and 1503, in accordance with various embodiments.

Figure 15B:
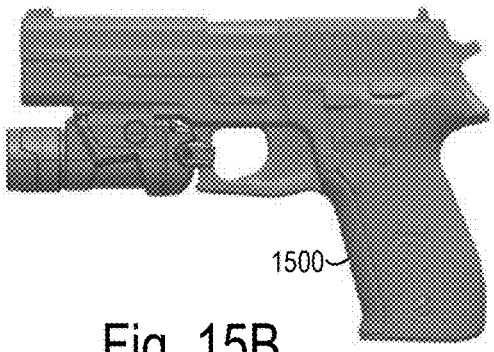
FIG. 15B depicts the light assembly 100 attached to the firearm 1500 of FIG. 15A, in accordance with various embodiments.

FIG. 15B depicts the light assembly 100 attached to the firearm 1500 of FIG. 15A, in accordance with various embodiments.

Although the light assembly is depicted in example implementations as a firearm-mounted light, other implementations are possible. For example, the light assembly could be mounted to a rail on a crossbow.

Figure 16A:
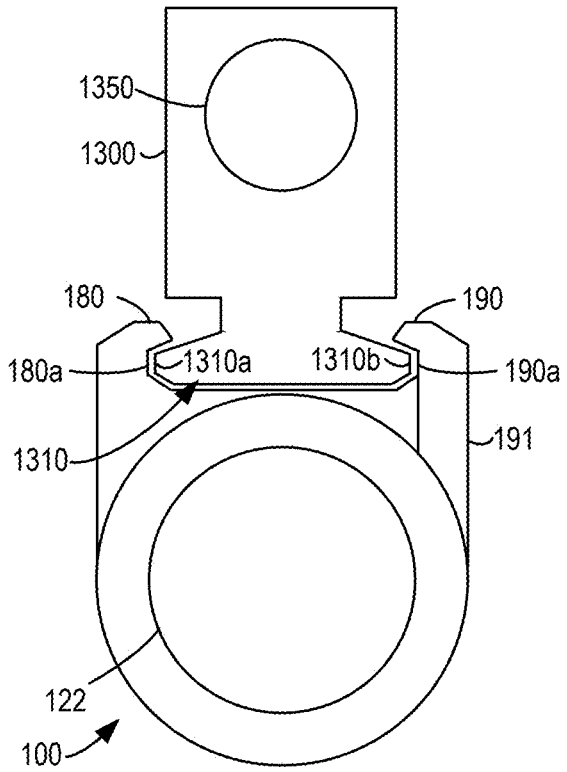
FIG. 16A depicts an example front view of the light assembly 100 and firearm 1300 of FIG. 13B, in accordance with various embodiments.

FIG. 16A depicts an example front view of the light assembly 100 and firearm 1300 of FIG. 13B, in accordance with various embodiments. The rail 1310 includes opposing first and second edges 1310*a* and 1310*b*, respectively, that can be engaged or clamped by the opposing clamping members 180 and 190, at inset region 180*a* and 190*a*, respectively, of the accessory when the accessory is installed on the rail. The lens 122 of the light assembly 100 and bore 1350 of the firearm 1300 are also depicted. The first and second edges extend in an axial direction of the accessory body and parallel to a length of the rail.

Figure 16B:
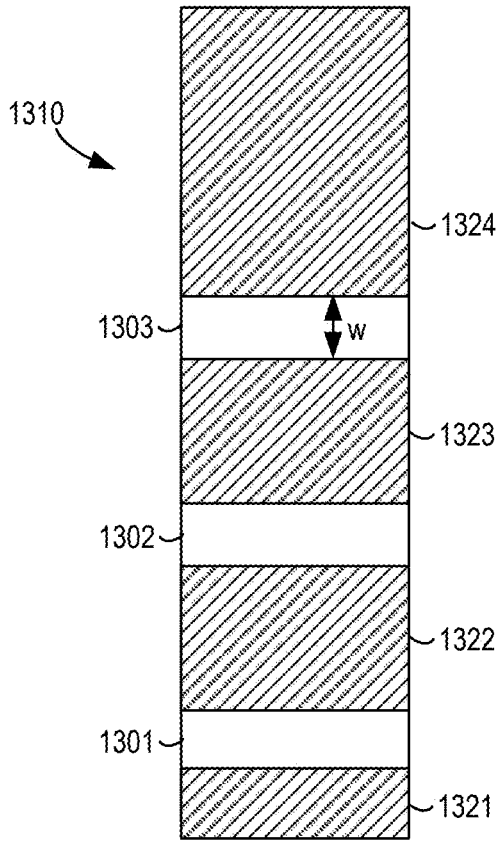
FIG. 16B depicts an example bottom view of the rail 1310 of FIG. 16A, in accordance with various embodiments.

FIG. 16B depicts an example bottom view of the rail 1310 of FIG. 16A, in accordance with various embodiments. The top and bottom of the figure correspond to rearward and forward positions, respectively, of the firearm, in this example. The rail includes the three channels 1301, 1302 and 1303 and flats (or stops) 1321, 1322, 1323 and 1324. Each channel is a recessed region between adjacent flats and may have a generally rectangular cross-section when viewed from a side of the firearm.

Figure 17:
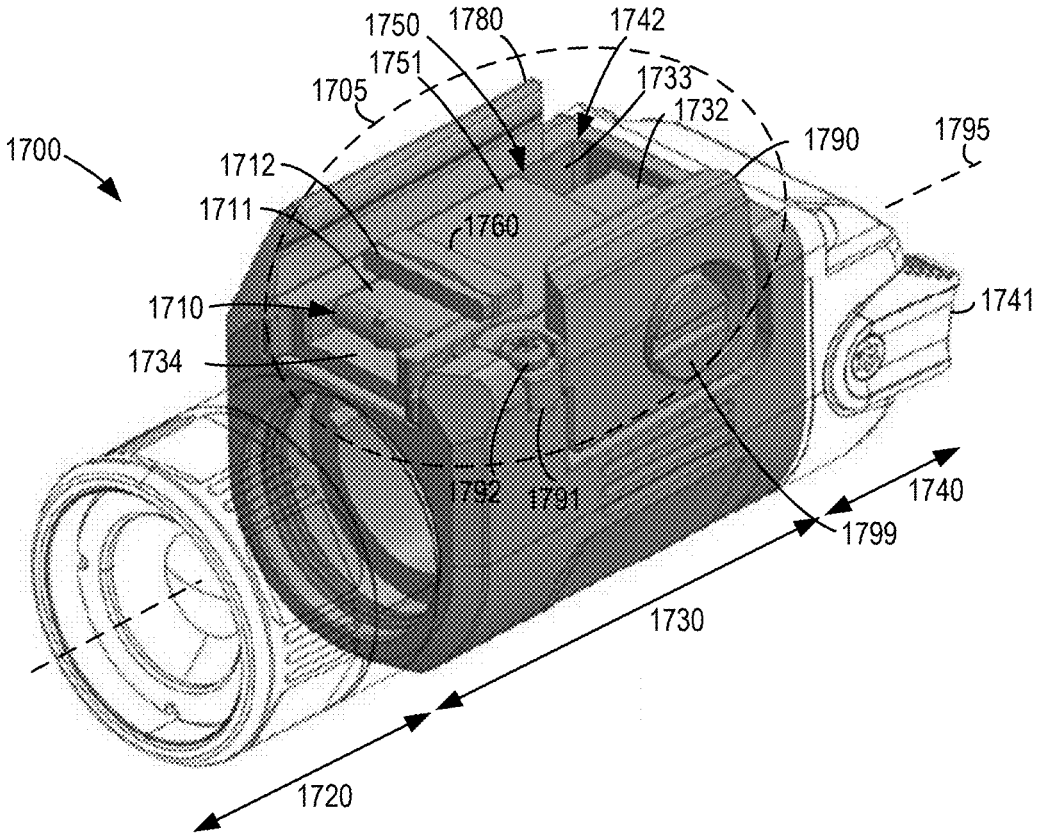
FIG. 17 depicts a view of another example light assembly 1700 that includes an accessory body 1730 having an adjustable rail mount 1705, in accordance with various embodiments.

FIG. 17 depicts a view of another example light assembly 1700 that includes an accessory body 1730 having an adjustable rail mount 1705, in accordance with various embodiments. Instead of using the accommodation screw 105 of FIG. 5, a selector 1710 may be coupled to a keying element 1750 that is held in the accessory body. The selector is configured to rotate relative to the keying element between a deployed or active position and a non-deployed or inactive position. In the deployed position, the selector portion 1712 extends above a surface 1751 of the keying element, and is positioned adjacent to a keying member 1760 of the keying element. In this position, a combined thickness of the selector portion 1712 and the keying member 1760 corresponds to a first channel thickness of a mounting rail of a firearm, such as a Picatinny rail. In the non-deployed position, the selector portion 1712 does not extend above the surface 1751, and is not positioned adjacent to the keying member 1760. In this position, the thickness of keying element alone corresponds to a second, smaller channel thickness of a mounting rail of a firearm, such as a Universal rail, also know as a Glock-style rail. The keying member 1760 and the selector portion 1712 may be shaped generally as rectangular bars in one approach.

A front of the accessory body 1730 is attached to an optic 1720 such as a lens, and the rear of the body (tail cap assembly 1740) includes one or more switches such as a switch 1741 to activate a light of the optic.

The adjustable rail mount 1705 is provided at the top of the body in this example to allow mounting to the underside of a rail, such as under the barrel of a handgun, but other configurations are possible. The adjustable rail mount 1705 could also be attached to another object other than a firearm.

The keying element 1750 can move fore and aft within a track 1742 of the accessory body 1730, which includes a channel 1733. The track includes a surface 1734. A threaded insert 1732 is also provided in the track to secure a screw 1799 (see also FIG. 19). The track extends in an axial direction of the accessory body, parallel to the longitudinal axis 1795 of the accessory. The keying element 1750 may have a surface 1751 at a first height. The keying member 1760 extends past (e.g., above) the surface to a greater second height. The keying member 1760 can be attached to, or integral with the surface 1751.

A fixed rail clamp 1780 (clamping member) and an opposing pivotable rail clamp 1790 (clamping member) can be used to secure the light assembly 1700 to the rail. The pivotable rail clamp 1790 includes a hinge 1791 to pivot about a pin 1792 that is inserted into the accessory body in a receptacle 1793 (see FIG. 19). When the screw 1799 is tightened, the rail clamp 1790 moves closer to the opposing rail clamp 1780 to tighten the accessory body 1730 to a firearm rail.

The selector 1710 includes a body 1711 and the selector portion 1712 arranged in an L configuration, in this example, when viewed from the side of the accessory body.

The adjustable rail mount 1705 can be used to secure the light assembly 1700 onto a firearm, typically a pistol, below the barrel and in front of the trigger guard. The adjustable, non-removable keying element 1750 can lock into position to fit industry standard rails to set the distance from the trigger guard.

The rail style selector 1710 helps to accommodate a proper fit between industry standard rails that have different channel widths. The rail clamp 1790 is used to secure the light assembly 1700 firmly to the rail. The screw 1799 is used to simultaneously prevent the keying element 1750 from changing positions and hold the rail clamp 1790 closed.

Figure 18:
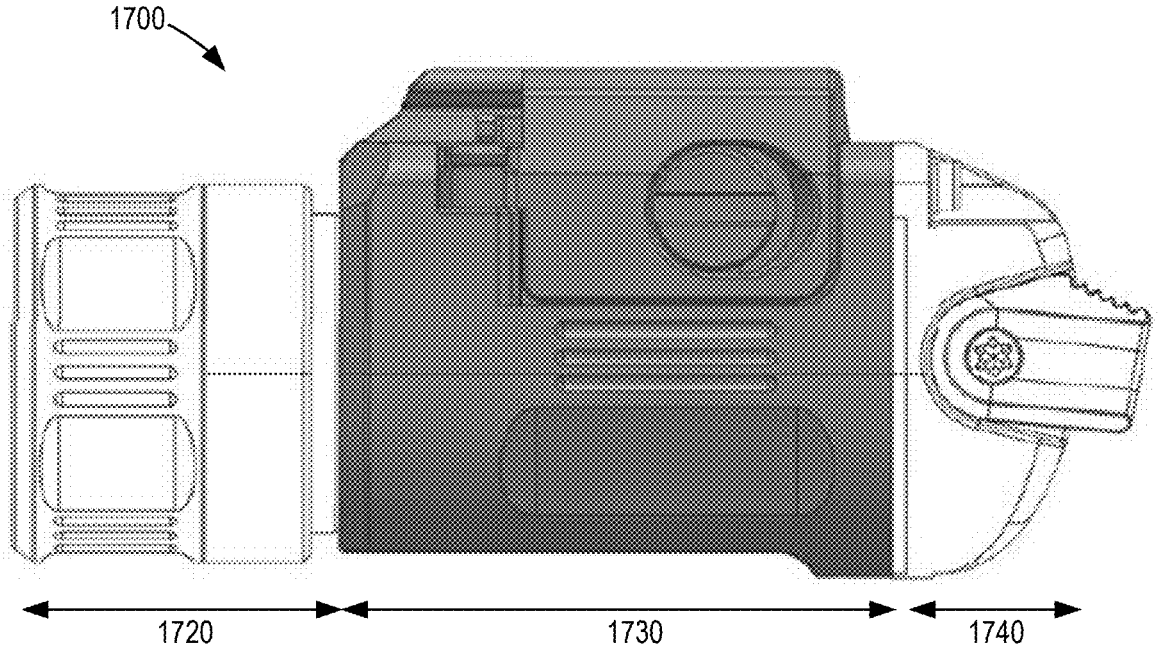
FIG. 18 depicts a side view of the example light assembly 1700 of FIG. 17, in accordance with various embodiments.

FIG. 18 depicts a side view of the example light assembly 1700 of FIG. 17, in accordance with various embodiments. This view depicts the accessory body 1730 with the front-mounted optic 1720 and the rear-mounted tail cap assembly 1740. The frontward direction is to the left and the rearward direction is to the right.

Figure 19:
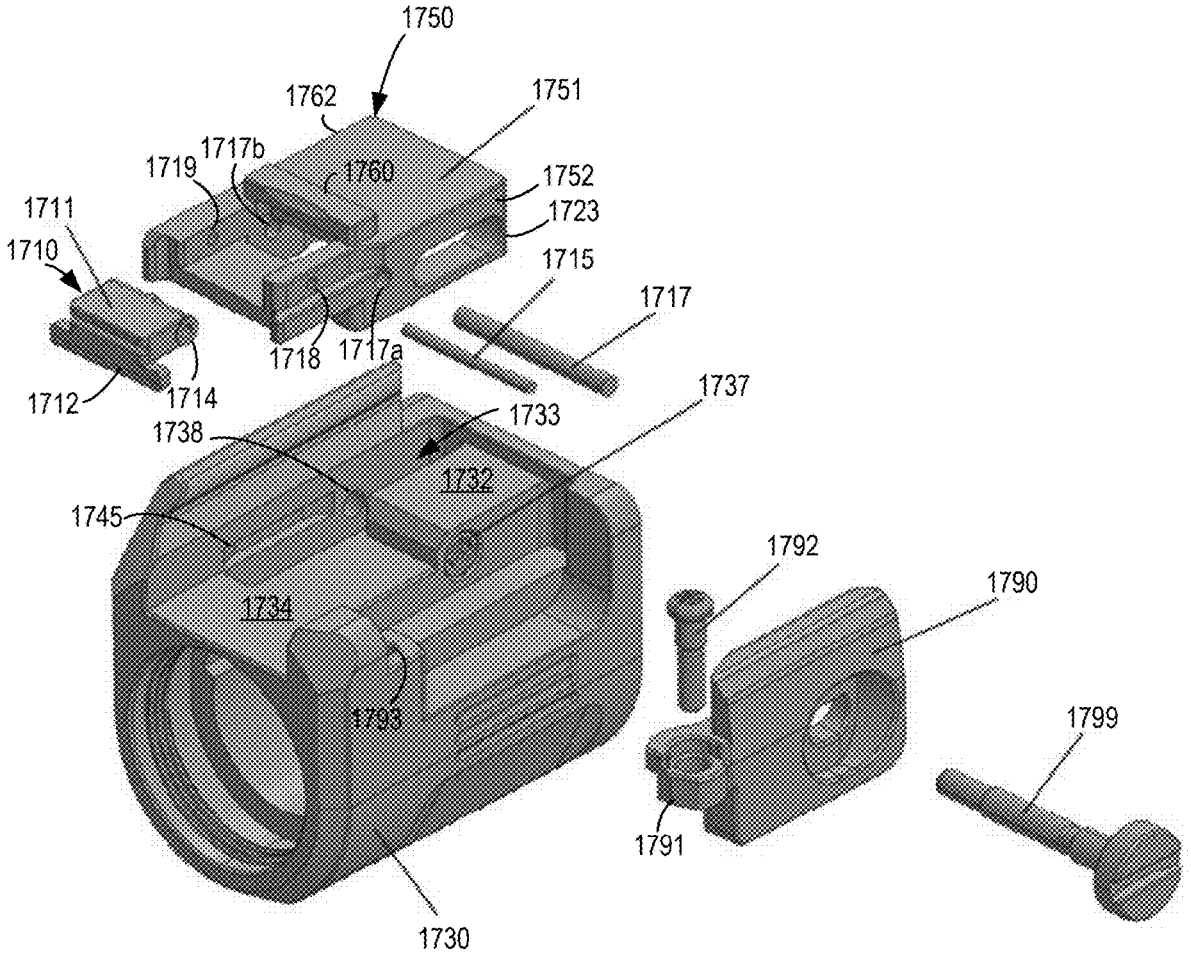
FIG. 19 depicts an exploded view of the accessory body 1730 of FIG. 17, in accordance with various embodiments.

FIG. 19 depicts an exploded view of the accessory body 1730 of FIG. 17, in accordance with various embodiments. The keying element 1750 includes opposing side walls 1752 and 1762. These can be vertical walls that extend from the horizontal surface 1751. The side wall 1752 includes an elongated opening 1723 or slot that extends in the axial direction. The screw 1799 can pass through the elongated opening and a threaded receptacle 1737 of the threaded insert 1732 to one opening of a set of circular openings 1731 on the side wall 1762 (see also FIGS. 23, 39 and 40) to adjust and lock the axial position of the keying element. The tip of the screw can extend further across the channel 1733 and into a receptacle 1738 of the accessory body.

A locking pin 1717 can pass through openings 1717*a* and 1717*b* in the opposing side walls of the keying element, and into a slot 1745 of the accessory body that extends in the axial direction. The locking pin is configured to slide transversely, through the openings 1717*a* and 1717*b*, and into the slot. This helps hold the keying element in place while allowing it to move axially along the length of the slot when the rail clamp 1790 is open, and before the screw 1799 enters one of the circular holes in the side wall 1762 of the keying element.

A pin 1715 can pass through the hinge 1714 of the selector 1710 and be held in openings 1718 and 1719 in the opposing walls of the keying element. The selector can rotate about an axis of the pin 1715 between the deployed and non-deployed positions.

Figure 20:
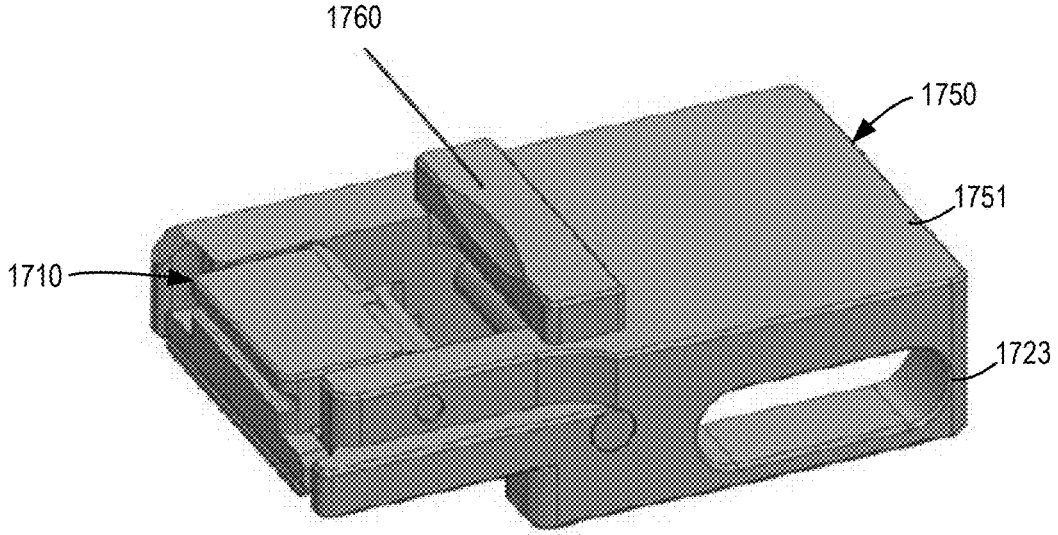
FIG. 20 depicts a top-side view of the keying element 1750 and the selector 1710 of FIG. 17, with the selector in a non-deployed position, in accordance with various embodiments.

FIG. 20 depicts a top-side view of the keying element 1750 and the selector 1710 of FIG. 17, with the selector in a non-deployed position, in accordance with various embodiments. In the non-deployed position, the selector does not extend past the surface 1751 of the keying element 1750, so that the keying member 1760 alone can be inserted into a channel of a firearm rail.

Figure 21:
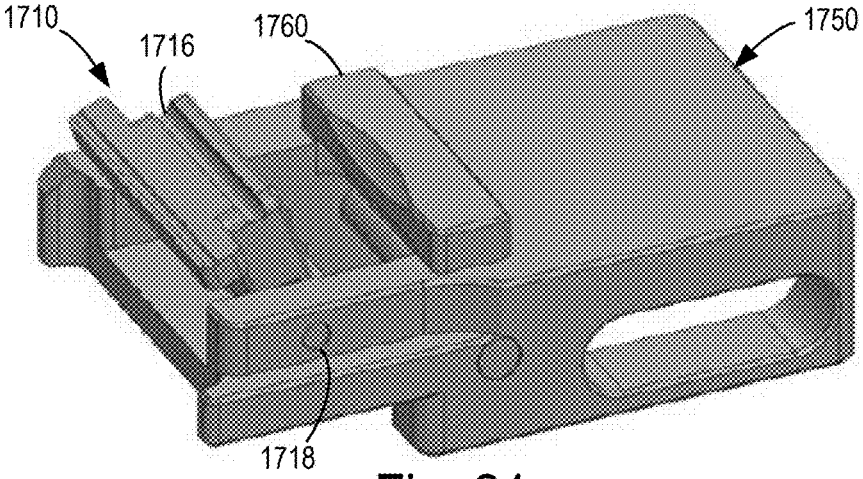
FIG. 21 depicts a top-side view of the keying element 1750 and the selector 1710 of FIG. 17, with the selector in an intermediate position, between the non-deployed position and a deployed position, in accordance with various embodiments.

FIG. 21 depicts a top-side view of the keying element 1750 and the selector 1710 of FIG. 17, with the selector in an intermediate position, between the non-deployed position and a deployed position, in accordance with various embodiments. The selector may have a groove 1716 that allows the user to insert their fingernail to move the selector to the deployed position.

Figure 22:
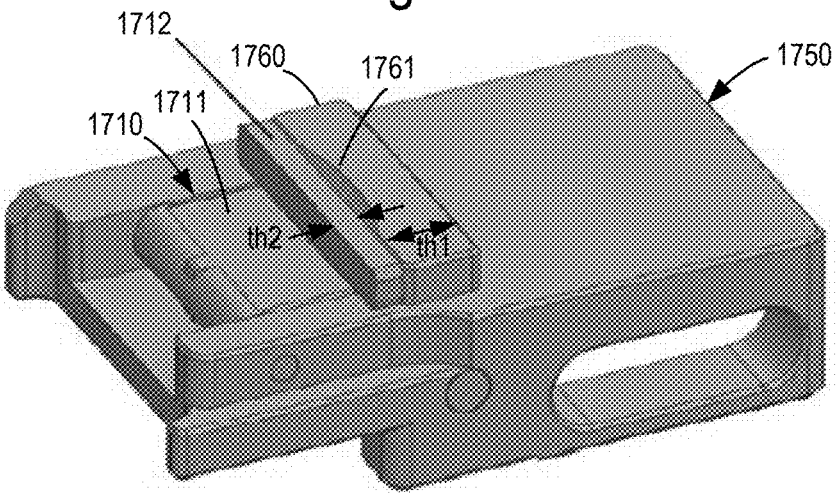
FIG. 22 depicts a top-side view of the keying element 1750 and the selector 1710 of FIG. 17, with the selector in a deployed position, such that the selector portion 1712 is adjacent to the keying member 1760, in accordance with various embodiments.

FIG. 22 depicts a top-side view of the keying element 1750 and the selector 1710 of FIG. 17, with the selector in a deployed position, such that the selector portion 1712 is adjacent to the keying member 1760, in accordance with various embodiments. In the deployed position, the selector extends past the surface 1751 of the keying element 1750, so that the keying member 1760 and the selector portion 1712 together can be inserted into a channel of a firearm rail. For example, the keying element may have a thickness (in the axial direction) of th1 and the selector portion 1712 may have a thickness th2. The combined thickness is therefore essentially th1+th2. A gap could be present between the keying element and the selector portion 1712, so that the combined thickness is increased by the gap thickness. The keying member 1760 has a cutaway region 1761 that allows the user to insert their fingernail to grasp the groove 1716 of the selector and move it back to the non-deployed position.

Figure 23:
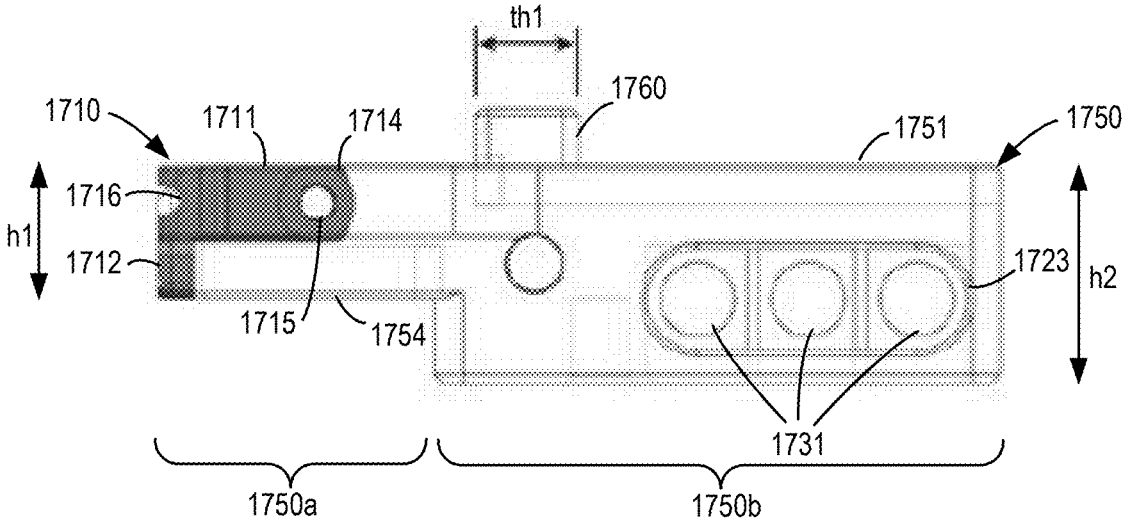
FIG. 23 depicts a side view of the keying element 1750 and the selector 1710 of FIG. 20, in accordance with various embodiments.

FIG. 23 depicts a side view of the keying element 1750 and the selector 1710 of FIG. 20, in accordance with various embodiments. The selector is in the non-deployed position. In this position, the body 1711 of the selector is flush or coplanar with the surface 1751 of the keying element. Additionally, the selector portion 1712 is flush with a bottom surface 1754 of the keying element. The keying element 150 has a part 1750*a* with a height h1 and a part 1750*b* with a height h2>h1, in this example implementation.

Figure 24:
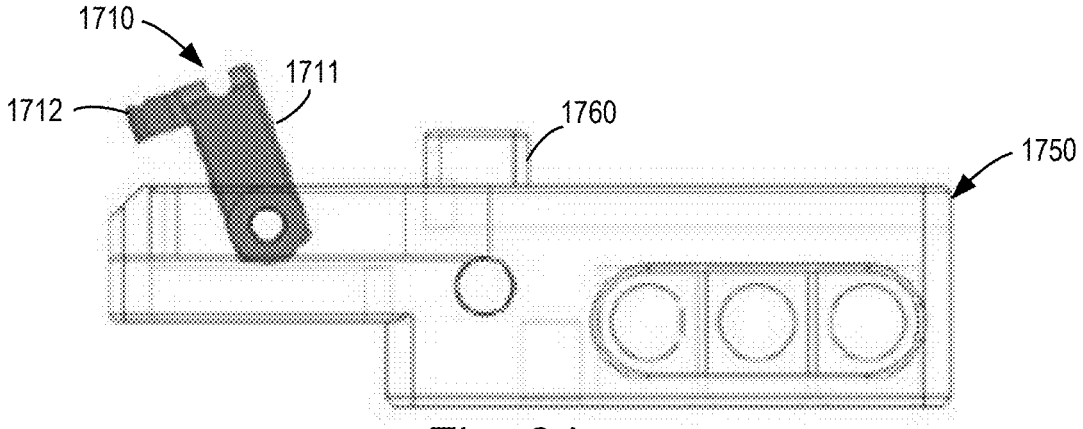
FIG. 24 depicts a side view of the keying element 1750 and the selector 1710 of FIG. 21, in accordance with various embodiments.

FIG. 24 depicts a side view of the keying element 1750 and the selector 1710 of FIG. 21, in accordance with various embodiments. The selector is in an intermediate position, between the non-deployed and deployed positions. The user can manually rotate the selector toward the deployed position.

Figure 25:
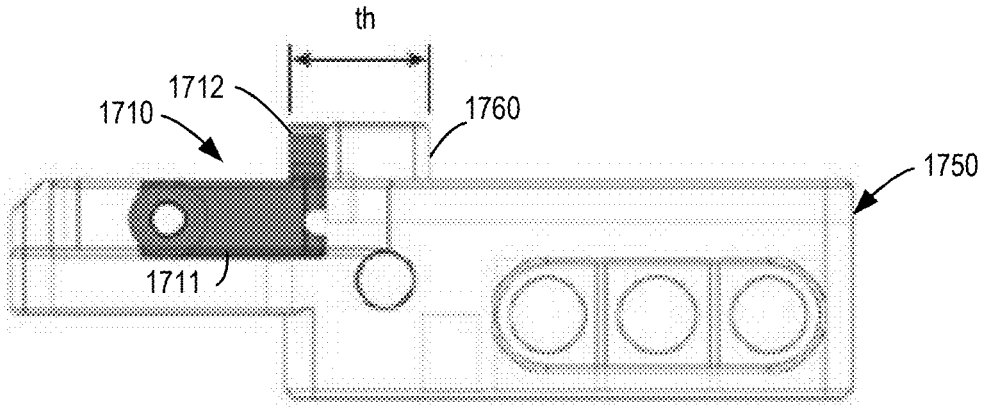
FIG. 25 depicts a side view of the keying element 1750 and the selector 1710 of FIG. 22, in accordance with various embodiments.

FIG. 25 depicts a side view of the keying element 1750 and the selector 1710 of FIG. 22, in accordance with various embodiments. The selector is in the deployed position, so that the selector portion 1712 is adjacent to the keying member 1760 to provide a combined thickness th. The selector can be easily rotated or flipped between the deployed and non-deployed positions by the user.

Figure 26:
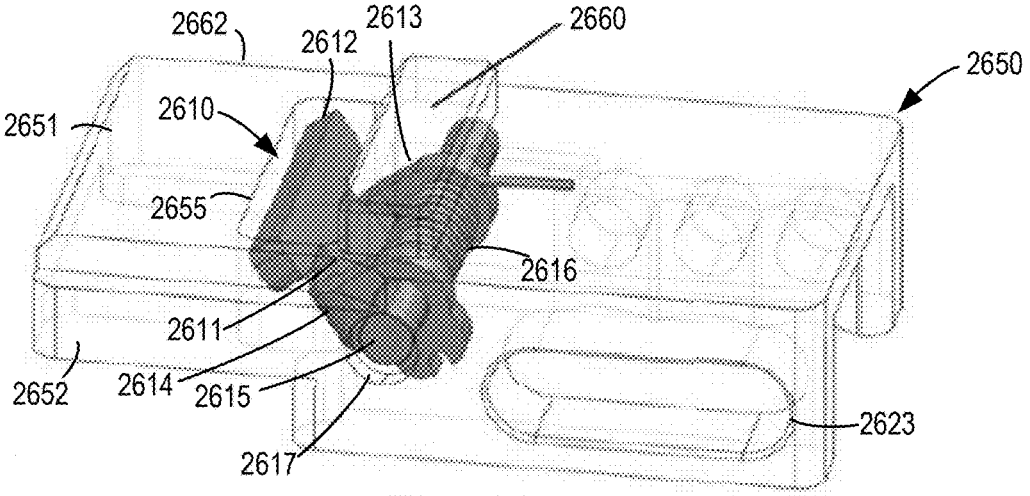
FIG. 26 depicts a view of another example keying element 2650 and a selector 2610, with the selector in a non-deployed position, in accordance with various embodiments.

FIG. 26 depicts a view of another example keying element 2650 and a selector 2610, with the selector in a non-deployed position, in accordance with various embodiments. The selector in this example is T-shaped and has a spring 2616 mounted to a spacer pin 2615 to bias the selector toward the deployed position. The spacer pin is held in openings on opposing sides 2652 and 2662 (or walls) of the keying element 2650, including an opening 2617 in the side wall 2652. The selector includes a central body 2611 and a portion 2612 that extends transversely. The central body is coupled on opposing sides to arms 2613 and 2614 that in turn are coupled to the spacer pin 2615. The surface 2651 of the keying element has an opening 2655 in which the selector can be stowed when in the non-deployed position.

The keying element also includes an elongated opening 2623 on the side wall 2652.

Figure 27:
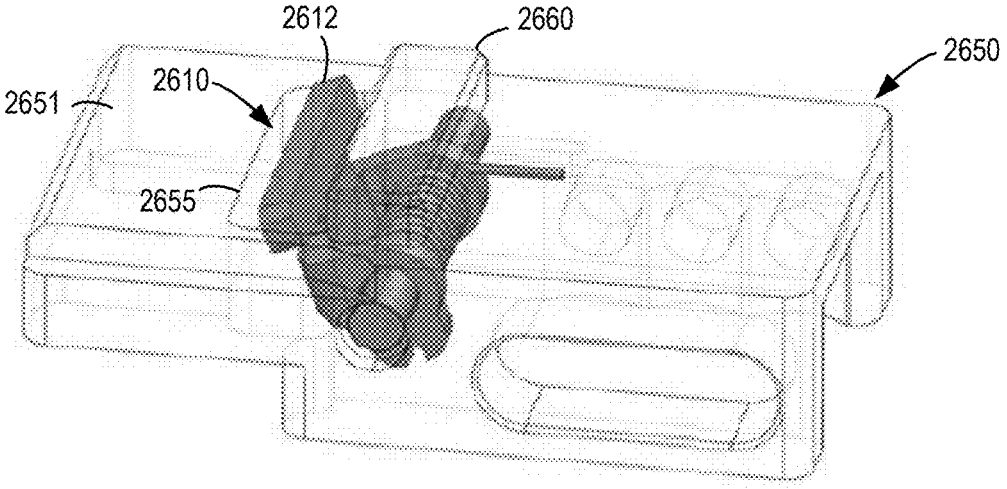
FIG. 27 depicts a view of the keying element 2650 with the selector 2610 of FIG. 26 in an intermediate position, between the non-deployed position and a deployed position, in accordance with various embodiments.

FIG. 27 depicts a view of the keying element 2650 with the selector 2610 of FIG. 26 in an intermediate position, between the non-deployed position and a deployed position, in accordance with various embodiments. The selector has rotated so that the portion 2612 protrudes through the opening 2655 and above the surface 2651 of the keying element.

Figure 28:
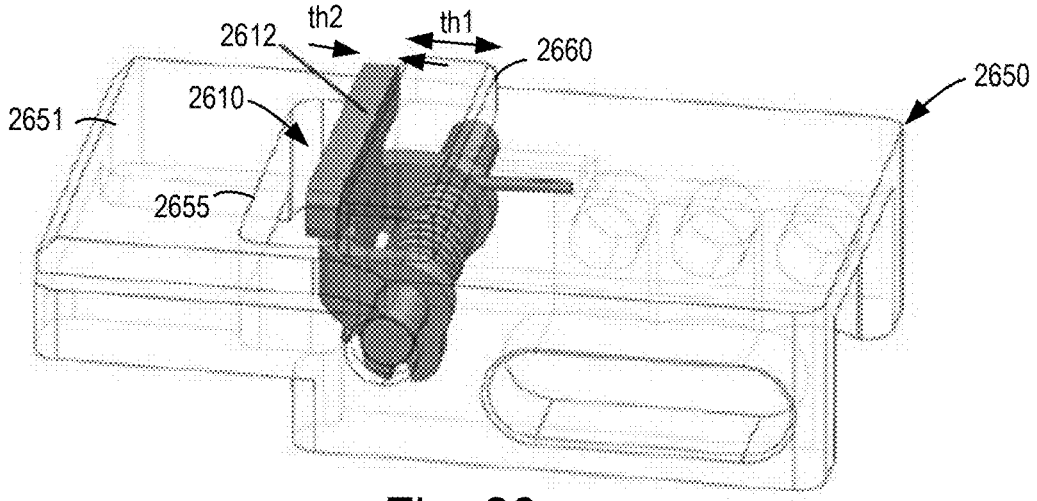
FIG. 28 depicts a view of the keying element 2650 with selector 2610 of FIG. 26 in a deployed position, such that a portion 2612 of the selector is adjacent to the keying element 2660, in accordance with various embodiments.

FIG. 28 depicts a view of the keying element 2650 with selector 2610 of FIG. 26 in a deployed position, such that a portion 2612 of the selector is adjacent to the keying element 2660, in accordance with various embodiments. In this position, the selector has rotated fully toward the keying element 2660 so that the portion 2612 (with a thickness th2) is adjacent to the keying element (with a thickness th1).

The alternate rail style selector 2610 is secured to the keying element 2650 with the spacer pin 2615 and the spring 2616 to maintain its upward or deployed position. When the selector is in its natural deployed position, the additional thickness th2 of the portion 2612 will combine with the thickness th1 of the keying element to provide a combined thickness that matches the channel width of Picatinny style rails, for example. When a narrower, e.g., Universal (Glock) style mount is encountered, the user simply presses the keying element 2660 into the corresponding channel of the rail. This movement applies pressure to the top of the portion 2612 of the selector 2610, pushing it down and out of the way, below the surface 2651. This user action matches the keying element to the narrower rail interface (keying member) on the firearm. Regardless of whether the selector is in the deployed or non-deployed position, it will maintain its position once the accessory body is mounted to the firearm rail and the screw 1799 and rail clamp 1790 are tightened against the rail. The same accessory body can therefore advantageously be used with firearms with different rail channel widths.

An advantage is that the user does not have to decide whether to deploy the selector since it deploys and retracts automatically.

Figure 29:
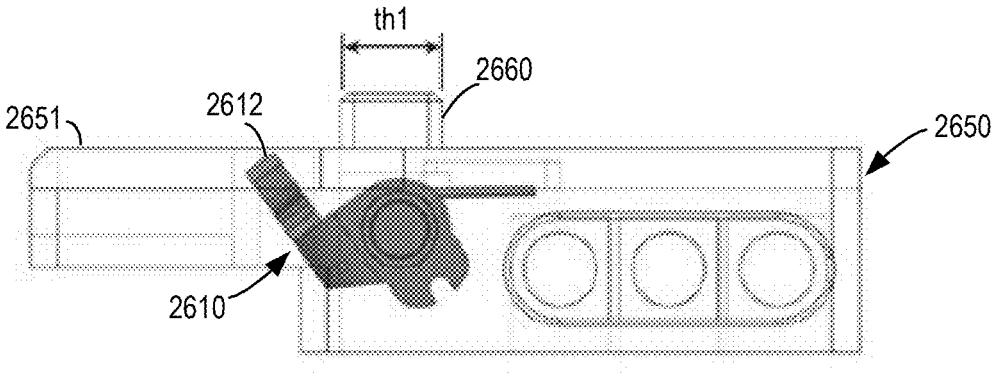
FIG. 29 depicts a side view of the keying element 2650 and selector 2610 of FIG. 26, in accordance with various embodiments.

FIG. 29 depicts a side view of the keying element 2650 and selector 2610 of FIG. 26, in accordance with various embodiments. The selector is in the non-deployed position.

Figure 30:
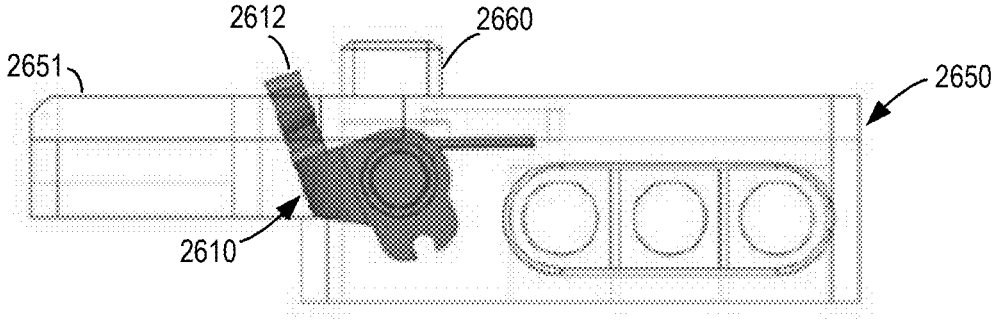
FIG. 30 depicts a side view of the keying element 2650 and selector 2610 of FIG. 27, in accordance with various embodiments.

FIG. 30 depicts a side view of the keying element 2650 and selector 2610 of FIG. 27, in accordance with various embodiments. The selector is in the intermediate position.

Figure 31:
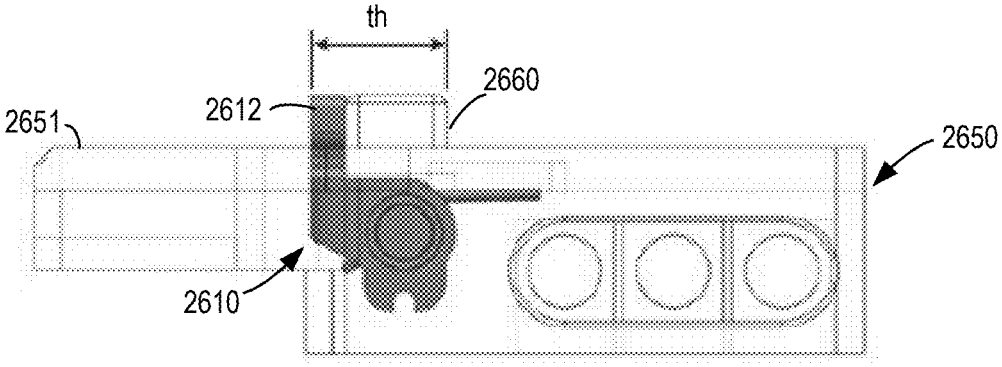
FIG. 31 depicts a side view of the keying element 2650 and selector 2610 of FIG. 28, in accordance with various embodiments.

FIG. 31 depicts a side view of the keying element 2650 and selector 2610 of FIG. 28, in accordance with various embodiments. The selector is in the deployed position. The combined thickness th is also depicted.

Figure 32:
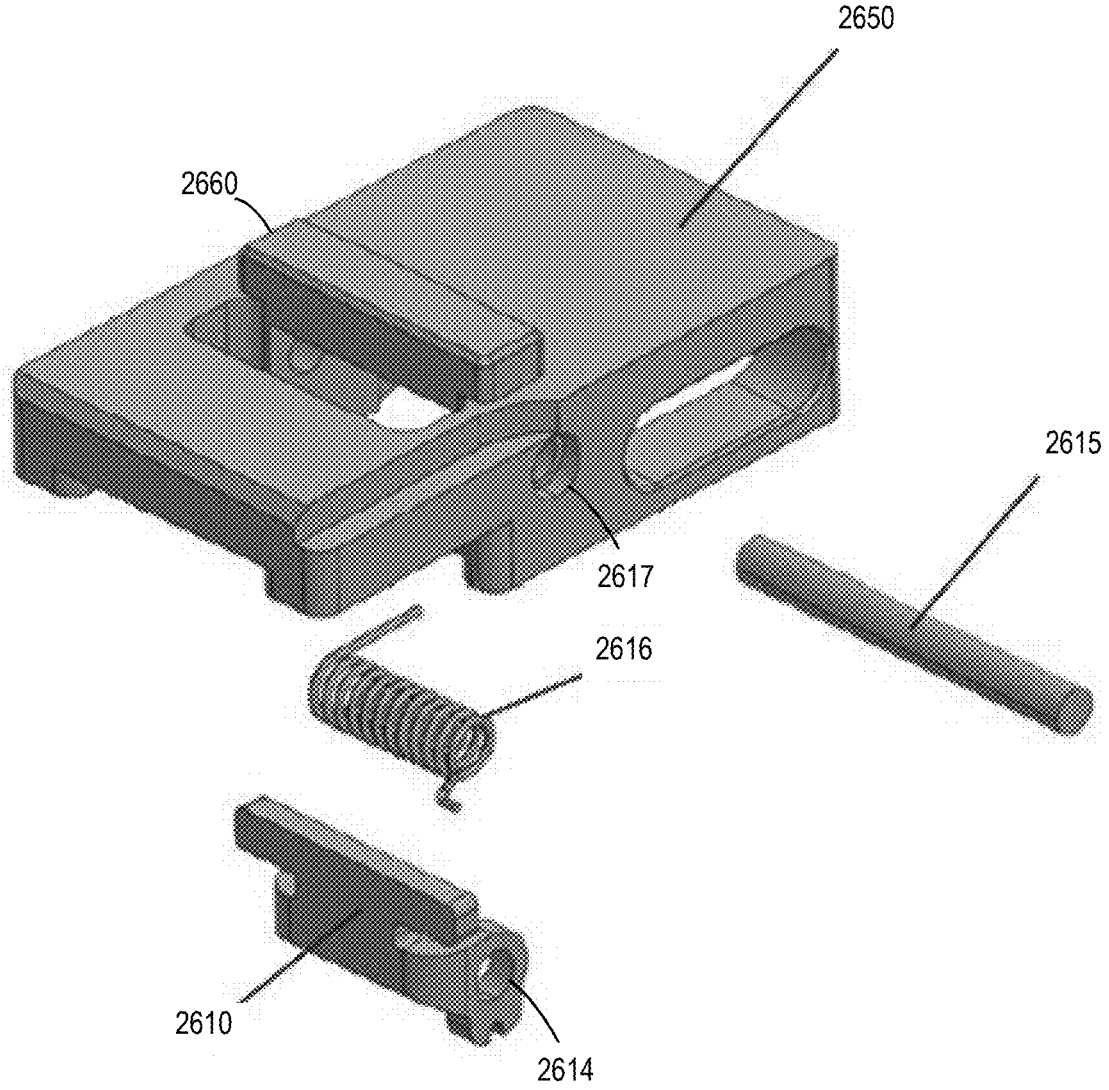
FIG. 32 depicts an exploded view of the keying element 2650 and selector 2610 of FIG. 26, in accordance with various embodiments.

FIG. 32 depicts an exploded view of the keying element 2650 and selector 2610 of FIG. 26, in accordance with various embodiments.

Figure 33:
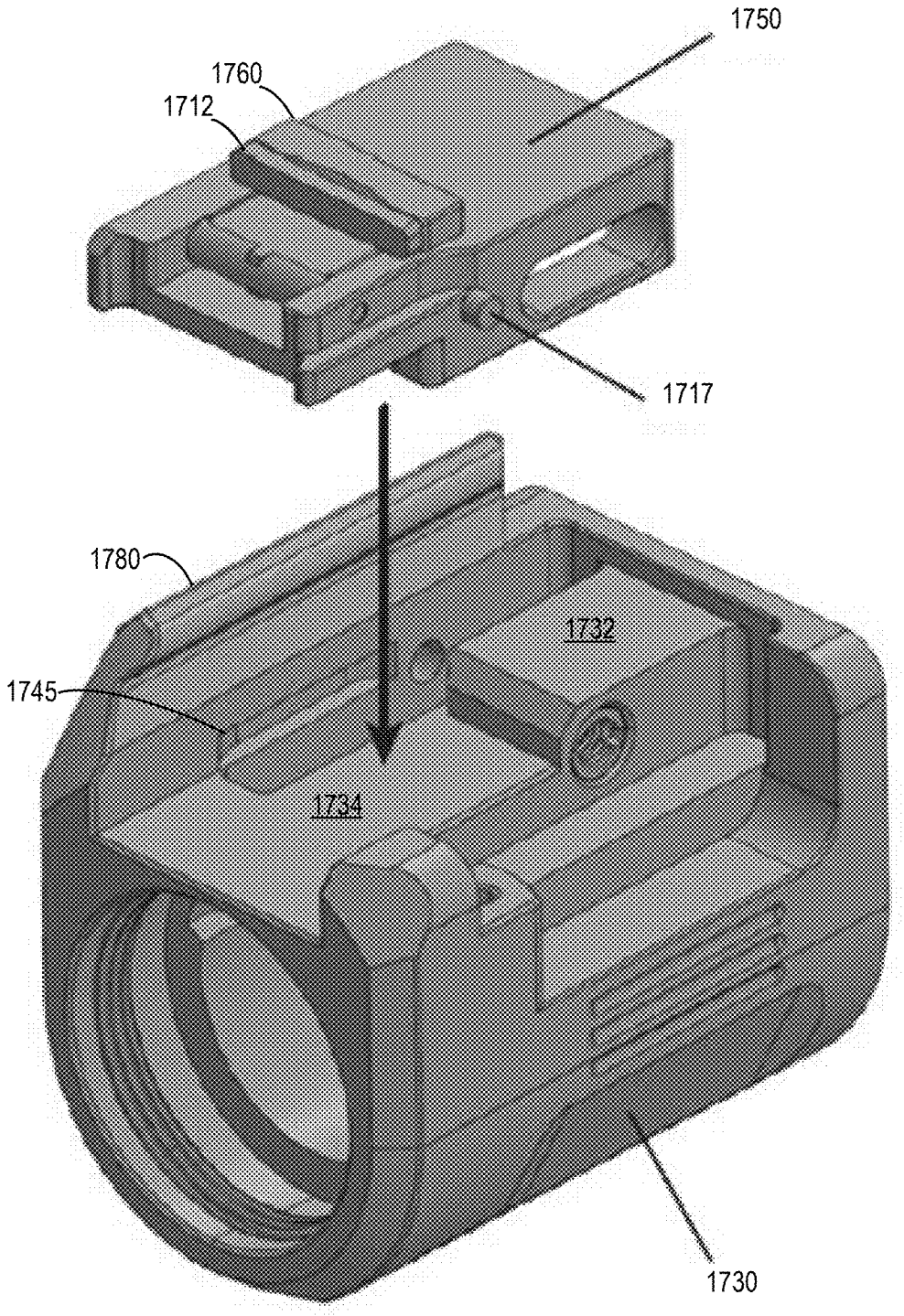
FIG. 33 depicts the keying element 1750 and selector 1710 of FIG. 17 being installed in the accessory body 1730 of FIG. 17, with the pin 1717 in an unlock position, in accordance with various embodiments.

FIG. 33 depicts the keying element 1750 and selector 1710 of FIG. 17 being installed in the accessory body 1730 of FIG. 17, with the pin 1717 in an unlock position, in accordance with various embodiments. With the pin 1717 protruding from the side of the keying element 1750, the keying element can be placed into the accessory body. The pin does not yet engage the slot 1745.

Figure 34:
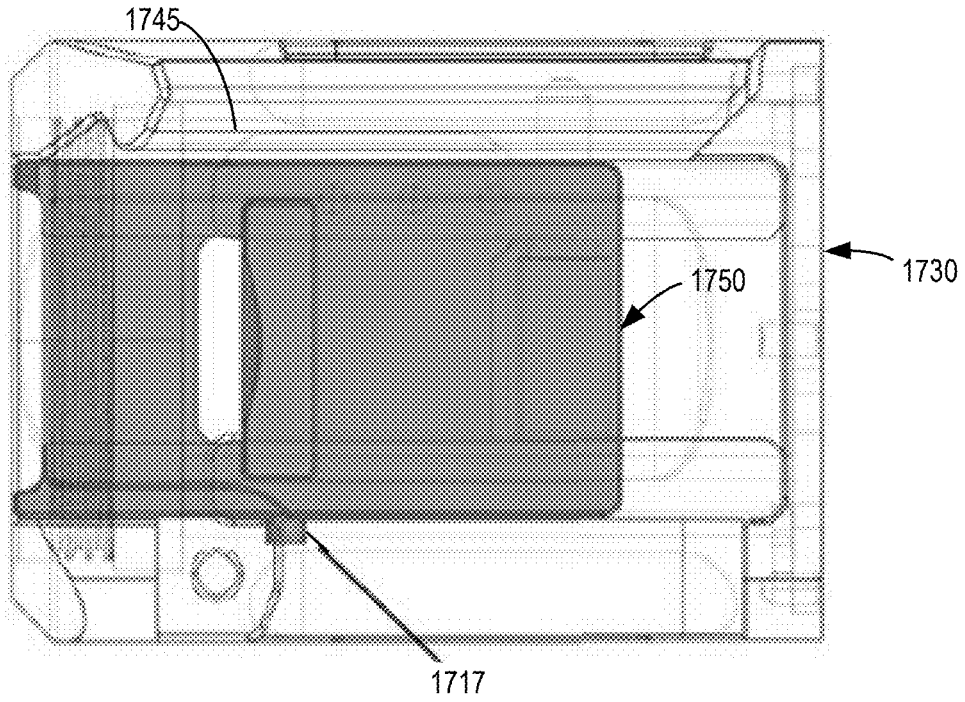
FIG. 34 depicts a top view of keying element 1750 of FIG. 33 inserted into the accessory body 1730, with the pin 1717 in an unlock position, in accordance with various embodiments.

FIG. 34 depicts a top view of keying element 1750 of FIG. 33 inserted into the accessory body 1730, with the pin 1717 in an unlock position, in accordance with various embodiments. The pin does not yet engage the slot 1745.

Figure 35:
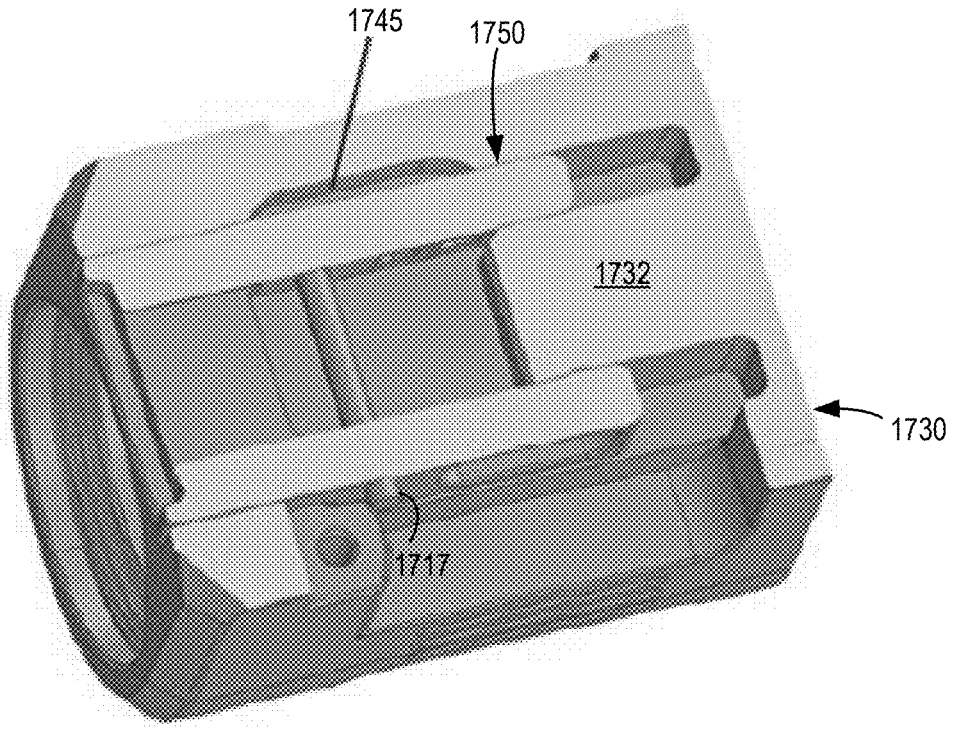
FIG. 35 depicts a cross-sectional view of the keying element 1750 and accessory body 1730 of FIG. 34, with the pin 1717 in an unlock position, in accordance with various embodiments.

FIG. 35 depicts a cross-sectional view of the keying element 1750 and accessory body 1730 of FIG. 34, with the pin 1717 in an unlock position, in accordance with various embodiments.

Figure 36:
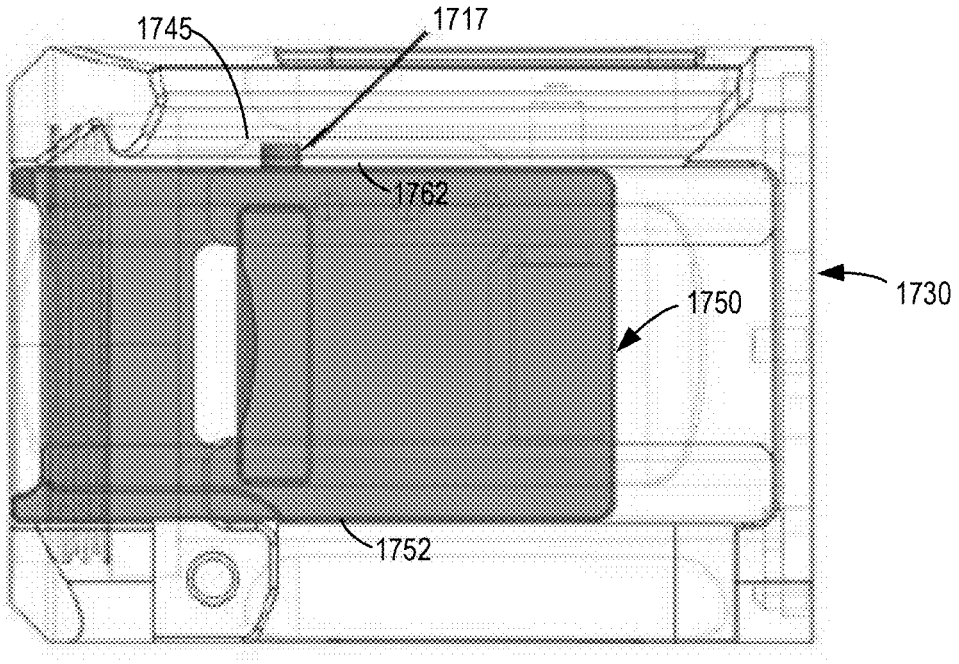
FIG. 36 depicts a top view of keying element 1750 of FIG. 33 inserted into the accessory body 1730, with the pin 1717 inserted into the slot 1745 in a lock position, in accordance with various embodiments.

FIG. 36 depicts a top view of keying element 1750 of FIG. 33 inserted into the accessory body 1730, with the pin 1717 inserted into the slot 1745 in a lock position, in accordance with various embodiments. In this approach, the spacer pin 2615 also acts as a locking pin when it is inserted into the slot 1745. The pin is pushed by the user in a transverse direction until it is flush with the side 1752 of the keying element, so that the other end of the pin protrudes from the opposing side wall 1762 of the keying element and into the slot 1745.

Once pressed into place, the locking pin 1717 will prevent the keying element from being removed from the accessory body, but still allow the keying element to change positions by sliding forward and back. The keying element will then be inseparable from the accessory body because the flush-pressed locking pin cannot be removed.

Figure 37:
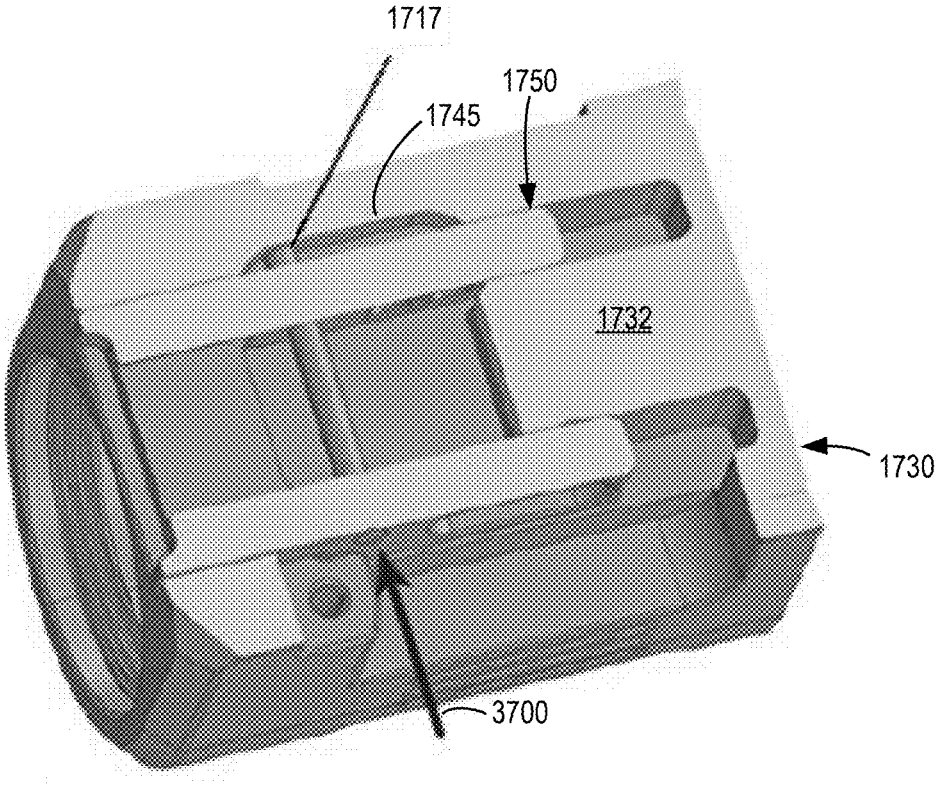
FIG. 37 depicts a cross-sectional view of the keying element 1750 and accessory body 1730 of FIG. 35, with the pin 1717 in the lock position, in accordance with various embodiments.

FIG. 37 depicts a cross-sectional view of the keying element 1750 and accessory body 1730 of FIG. 35, with the pin 1717 in the lock position, in accordance with various embodiments. The pin can be pushed by the user in the direction of the arrow 3700 to move it to the lock position.

Figure 38:
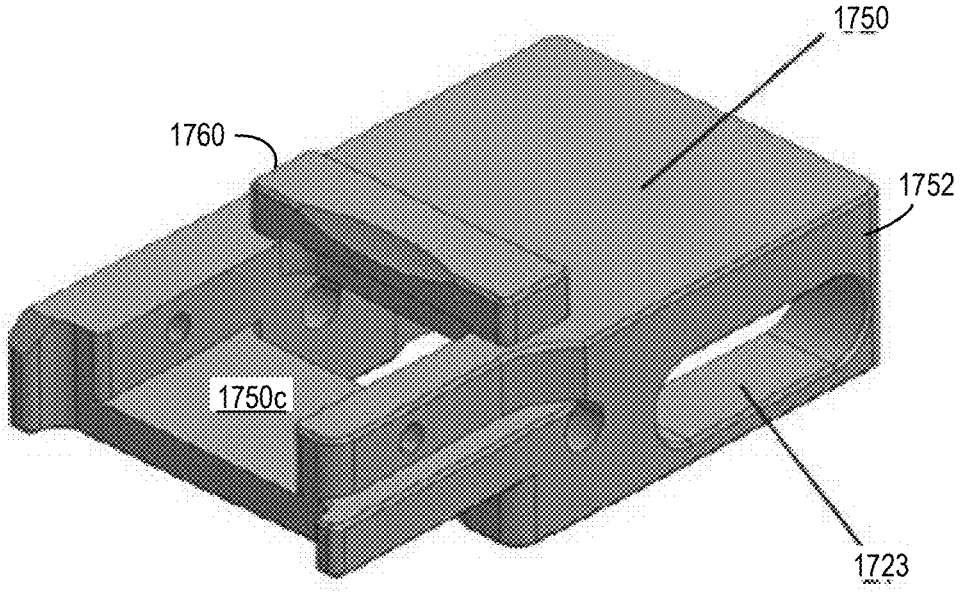
FIG. 38 depicts a front-right view of the keying element 1750 without the selector 1710, showing the elongated opening 1723, in accordance with various embodiments.

FIG. 38 depicts a front-right view of the keying element 1750 without the selector 1710, showing the elongated opening 1723, in accordance with various embodiments. A surface 1750*c* of the keying element 1750 is also depicted. The body 1711 of the selector 1710 can rest against this surface when the selector is in the non-deployed position.

Figure 39:
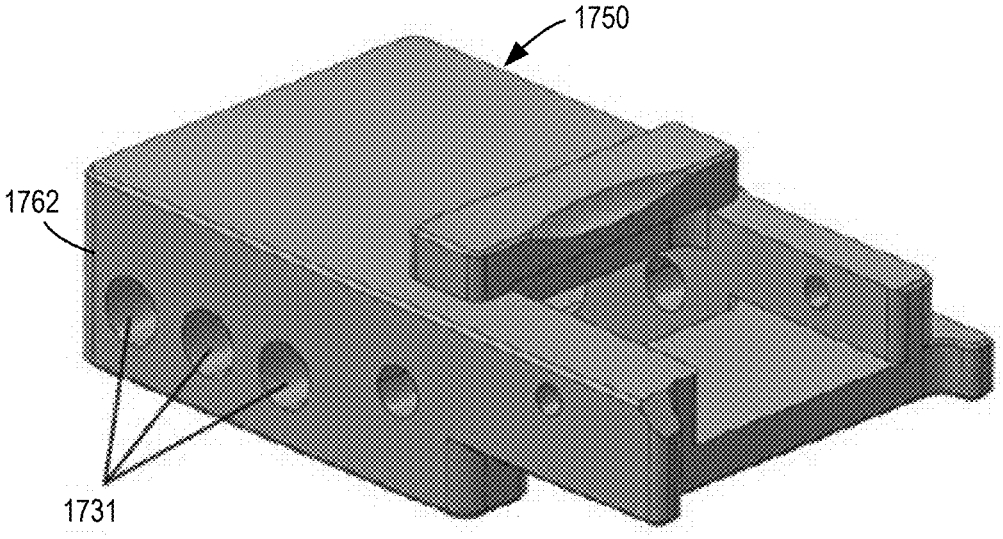
FIG. 39 depicts a front-left view of the keying element 1750 without the selector 1710, showing the set of openings 1731, in accordance with various embodiments.

FIG. 39 depicts a front-left view of the keying element 1750 without the selector 1710, showing the set of openings 1731, in accordance with various embodiments. The set of openings can include two or more openings. Three openings are provided in this example. The openings can be circular holes to accommodate the screw 1799. The openings are equally spaced in axial direction this example. Each opening corresponds to a discrete position of the keying element 1750 relative to the accessory body 1730. The user can position the screw in one of the openings to provide a desired position of the accessory body 1730 on the firearm rail. For example, the accessory body can be positioned at different distances from the trigger guard.

Figure 40:
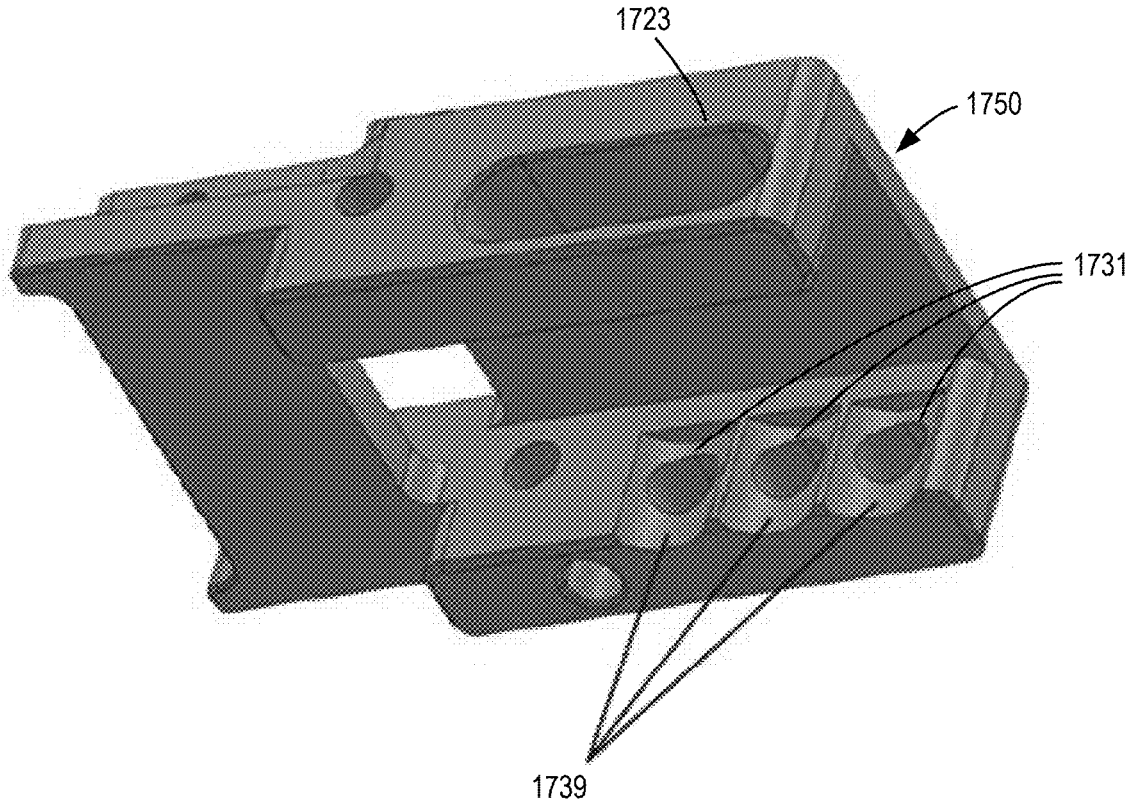
FIG. 40 depicts a bottom view of the keying element 1750 without the selector 1710, showing the elongated opening 1723, set of openings 1731, and cutouts 1739 for the set of openings, in accordance with various embodiments.

FIG. 40 depicts a bottom view of the keying element 1750 without the selector 1710, showing the elongated opening 1723, set of openings 1731, and cutouts 1739 for the set of openings, in accordance with various embodiments. The cutouts facilitate the placement of the screw 1799 in one of the circular openings by guiding the tip of the screw toward the opening. The cutouts can be concave, for example. In another option, the cutouts are frustoconical.

Figure 41:
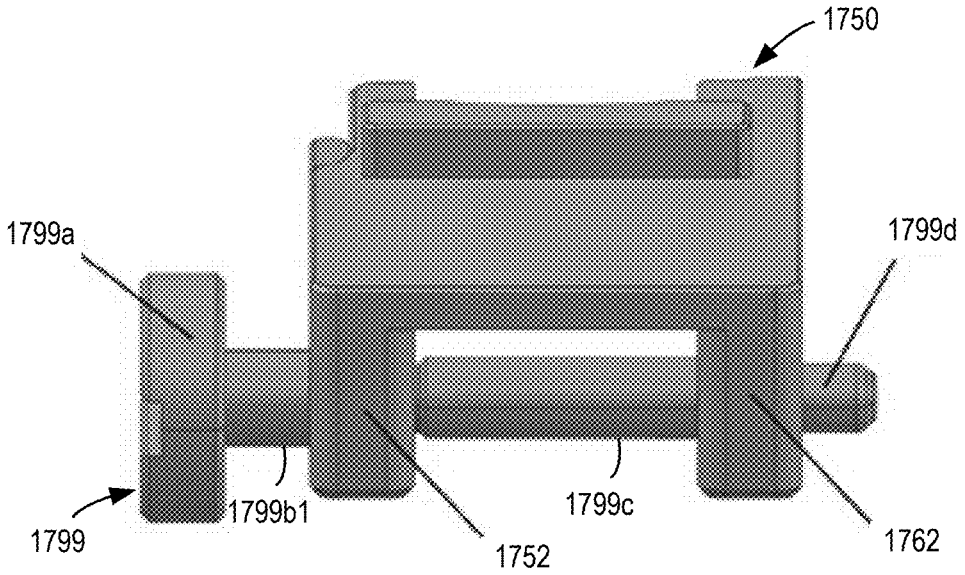
FIG. 41 depicts a rear view of the keying element 1750 and the screw 1799, where the screw is in a completely installed position, in accordance with various embodiments.

FIG. 41 depicts a rear view of the keying element 1750 and the screw 1799, where the screw is in a completely installed position, in accordance with various embodiments. The screw includes a head 1799*a*, a relatively thick unthreaded shoulder 1799*b*1 adjacent to the head, a relatively thin unthreaded shoulder 1799*b*2 adjacent to the thick unthreaded shoulder, a threaded middle portion 1799*c* adjacent to the thin unthreaded shoulder, and an unthreaded tip 1799*d* adjacent to the threaded middle portion.

The screw 1799 passes through the elongated opening 1723 that allows the keying element to be adjusted. When the screw passes through one of the openings 1731, it will lock the position of the keying element.

When the screw is fully installed, the shoulder 1799*b*1 will closely match the dimensions of the elongated opening and the tip 1799*d* will closely match the diameter of the openings 1731. The tip may protrude past the keying element, into the channel 1733, when fully installed. See also FIG. 44.

The threaded middle portion 1799*c* is long enough to maintain thread engagement with the threaded insert 1732 in the accessory body when partially unscrewed. Additionally, the inside of the keying element may have cutouts 1739, as mentioned (FIG. 40), to help the tip of the screw 1799 align itself with the openings 1731.

Figure 42:
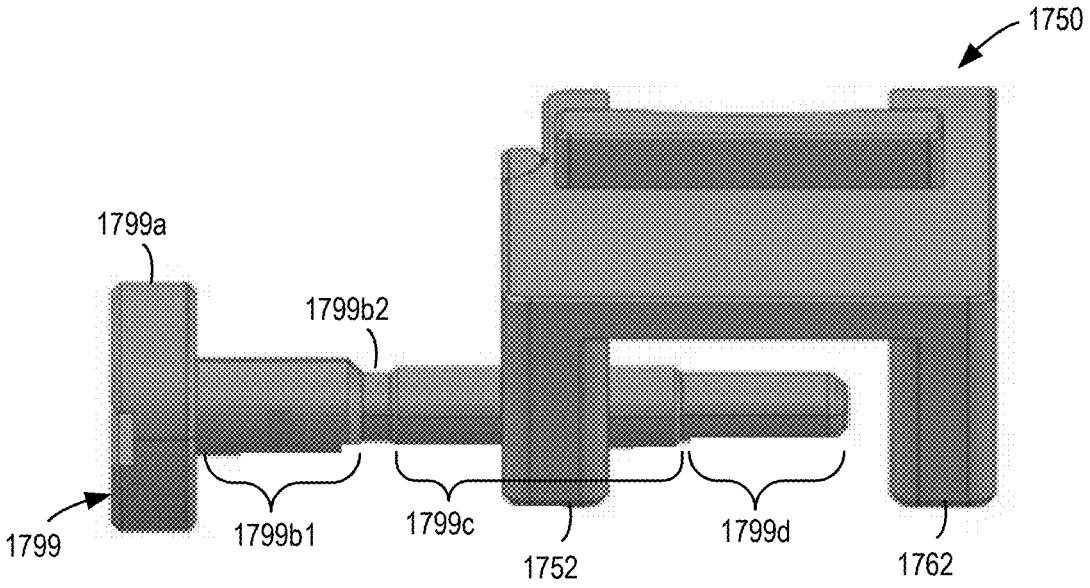
FIG. 42 depicts a rear view of the keying element 1750 and the screw 1799, where the screw is in a partially installed position, in accordance with various embodiments.

FIG. 42 depicts a rear view of the keying element 1750 and the screw 1799, where the screw is in a partially installed position, in accordance with various embodiments. The threaded middle portion 1799*c* engages a thread portion of the side wall 1752 of the keying element.

Figure 43:
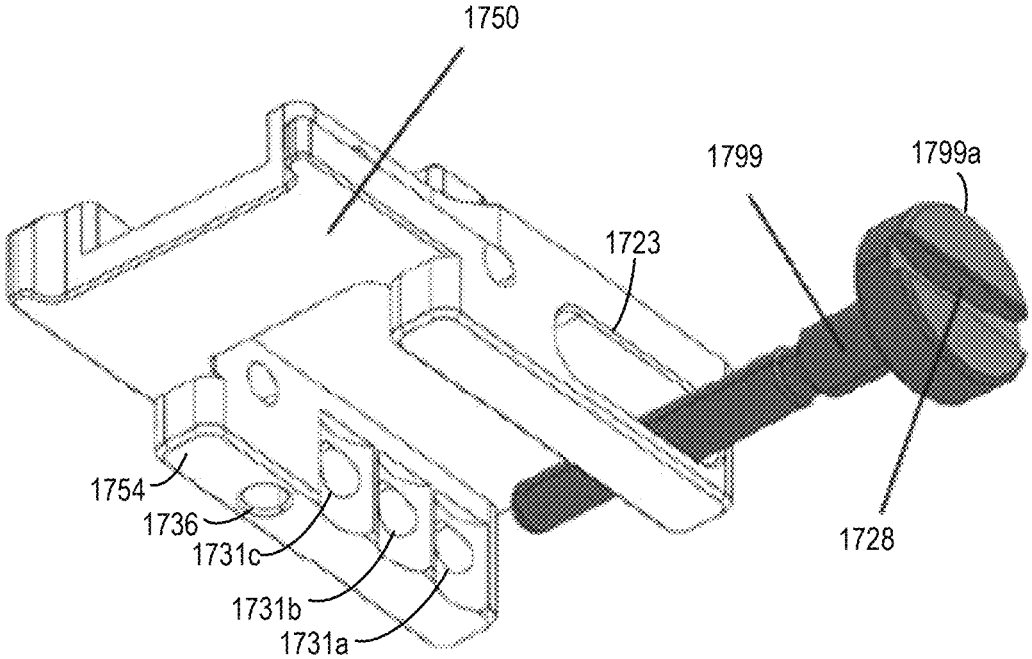
FIG. 43 depicts a bottom view of the keying element 1750 with the screw 1799 inserted through the elongated opening, in accordance with various embodiments.

FIG. 43 depicts a bottom view of the keying element 1750 with the screw 1799 inserted through the elongated opening, in accordance with various embodiments. The head 1799*a* of the screw may have a slot 1728 cut for a flat head screwdriver. The inside of the slot may be rounded slightly to match the radius of a coin, making it easier to adjust the screw with a coin and without tools. The individual openings 1731*a*, 1731*b* and 1731*c* are depicted.

Figure 49:
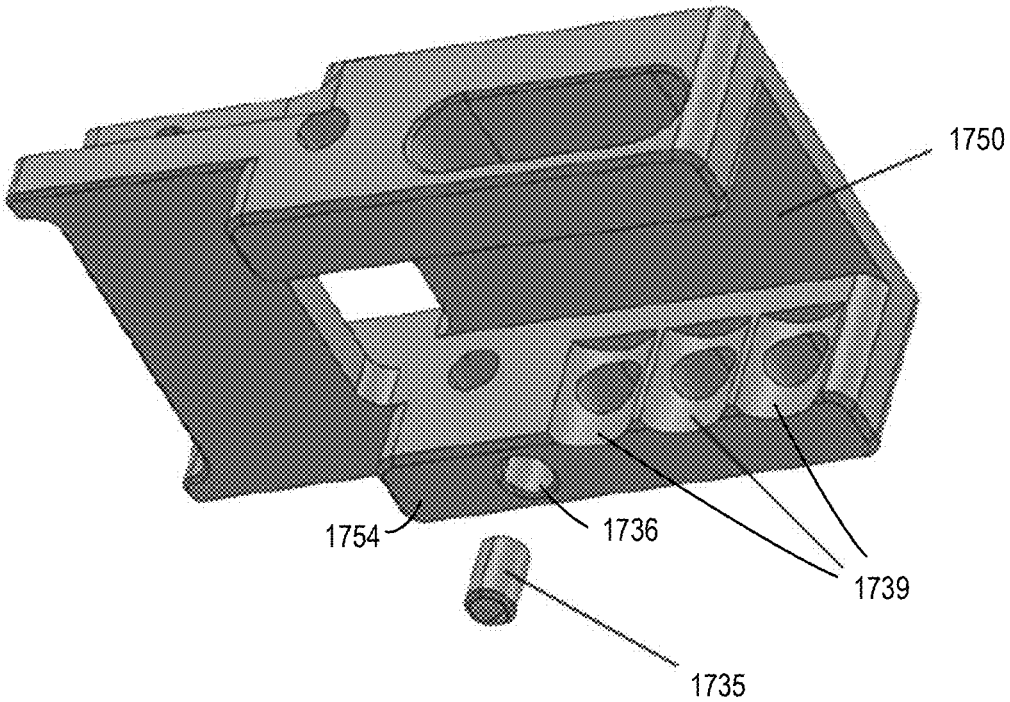
FIG. 49 depicts an exploded bottom view of the keying element 1750 including a receptacle 1736 for a spring-loaded detent 1735, in accordance with various embodiments.
Figure 50:
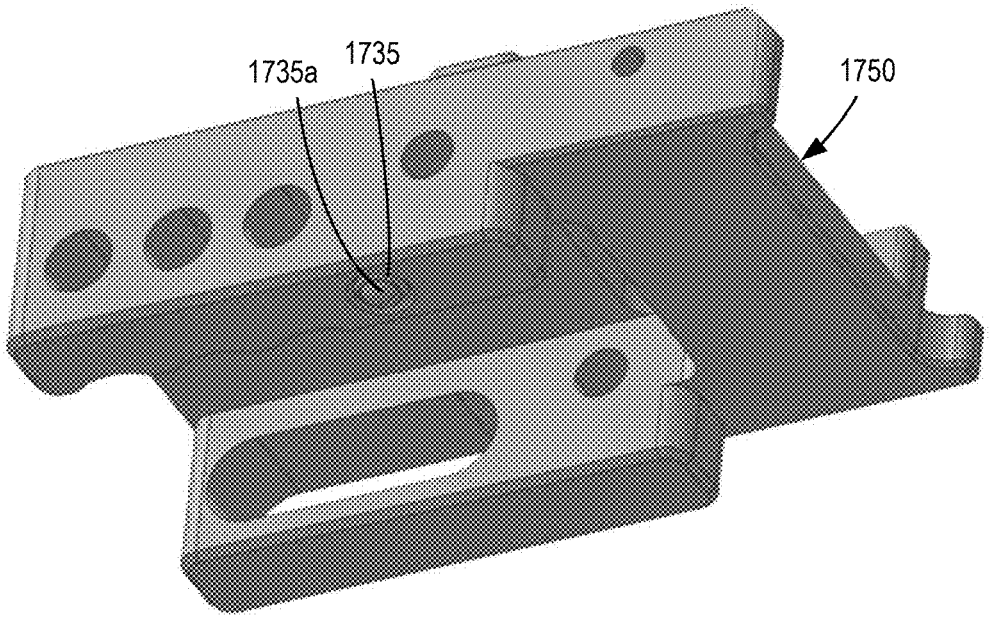
FIG. 50 depicts a bottom view of the keying element 1750 with the spring-loaded detent 1735 installed, in accordance with various embodiments.

The bottom surface 1754 of the keying element may include a receptacle 1736 for a spring detent (see also FIGS. 49 and 50).

Figure 44:
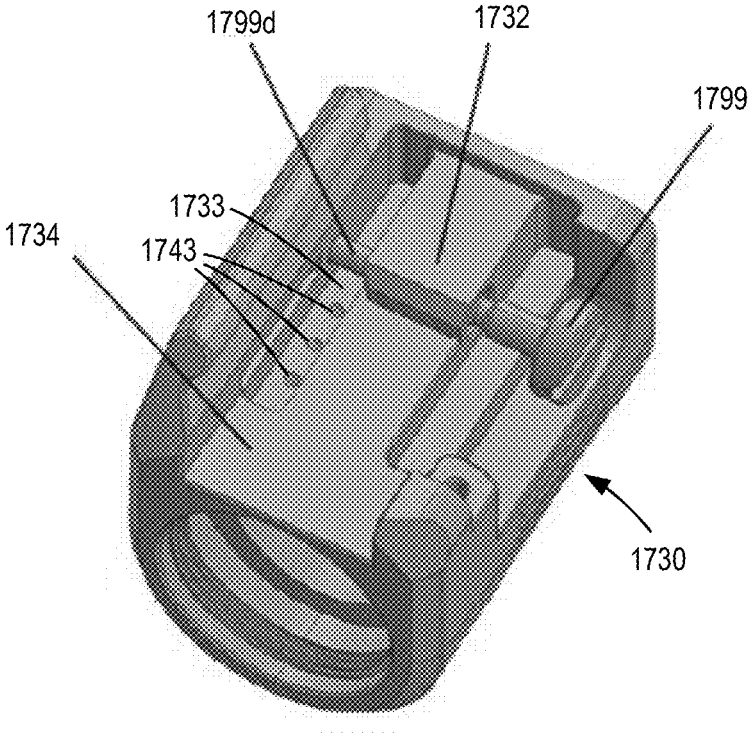
FIG. 44 depicts a top view of the accessory body 1730 with the screw 1799 in the completely installed position, where the tip 1799*d* of the screw extends into a channel 1733, in accordance with various embodiments.

FIG. 44 depicts a top view of the accessory body 1730 with the screw 1799 in the completely installed position, where the tip 1799*d* of the screw extends into a channel 1733, in accordance with various embodiments. When the screw 1799 is completely installed, it will thread through the threaded insert 1732, in a middle section of the accessory body, and the tip 1799*d* of the screw will block the internal channel 1733. Note that the screw does not passing completely through the accessory body in this example.

A set of indentations 1743 can be provided for use with the spring loaded detent 1735 (FIGS. 49 and 50).

Figure 45:
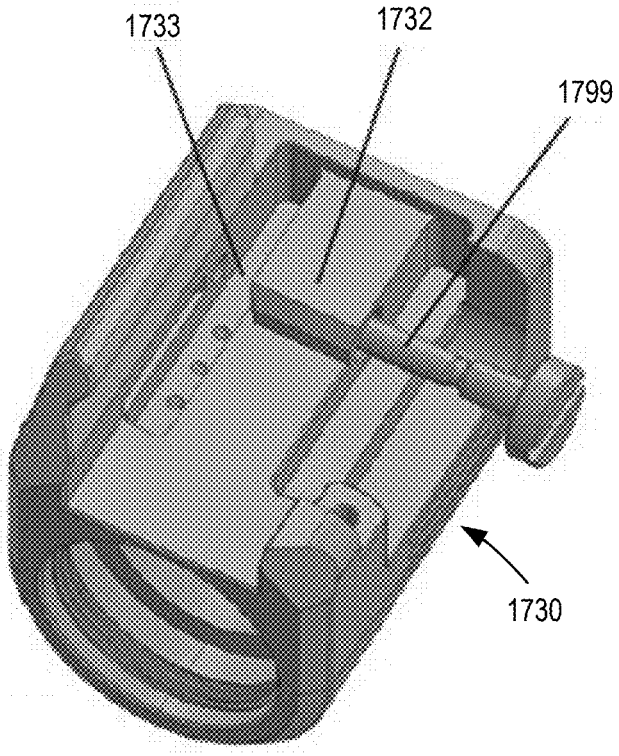
FIG. 45 depicts a top view of the accessory body 1730 with the screw 1799 in the partially installed position, where the tip 1799*d* of the screw clears the channel 1733, in accordance with various embodiments.

FIG. 45 depicts a top view of the accessory body 1730 with the screw 1799 in the partially installed position, where the tip 1799*d* of the screw clears the channel 1733, in accordance with various embodiments. When the screw is unscrewed slightly, the tip of the screw will no longer block the internal channel 1733, allowing the keying element to be moved fore or aft so that the screw can be inserted into any of the openings 1731. When the screw is partially unscrewed from the threaded insert 1732, the threads of the screw remain partially engaged with the accessory body 1730 and the screw is shifted to one side of the accessory body.

Figure 46:
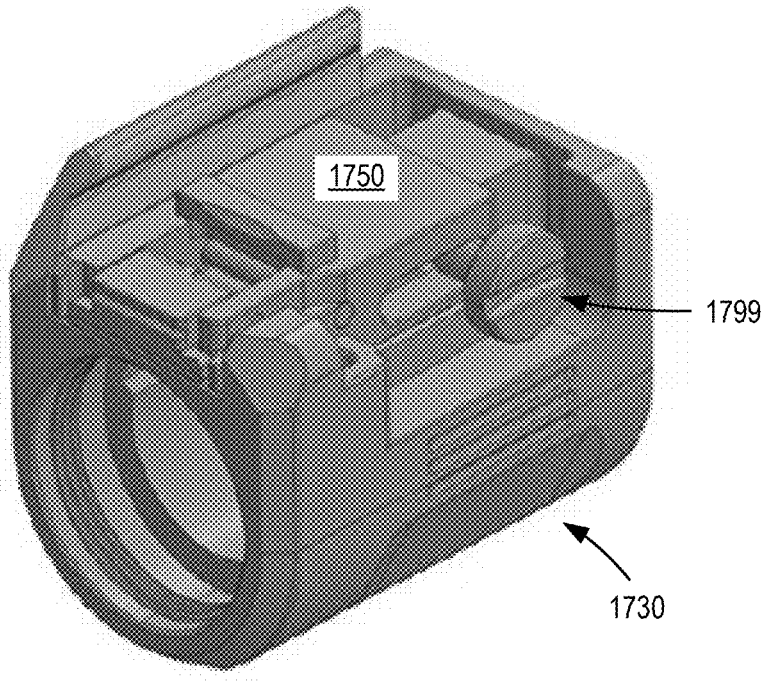
FIG. 46 depicts a view of the accessory body 1730 with the keying element 1750 in a first, front position, in accordance with various embodiments.

FIG. 46 depicts a view of the accessory body 1730 with the keying element 1750 in a first, front position, in accordance with various embodiments. The screw 1799 is inserted into the opening 1731*a* of FIG. 43.

Figure 47:
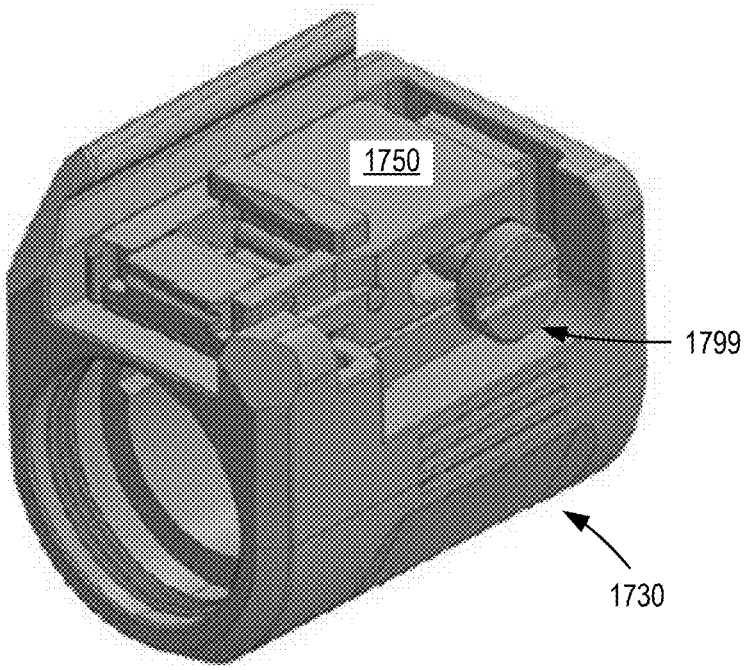
FIG. 47 depicts a view of the accessory body 1730 with the keying element 1750 in a second, intermediate position, in accordance with various embodiments.

FIG. 47 depicts a view of the accessory body 1730 with the keying element 1750 in a second, intermediate position, in accordance with various embodiments. The screw 1799 is inserted into the opening 1731*b* of FIG. 43.

Figure 48:
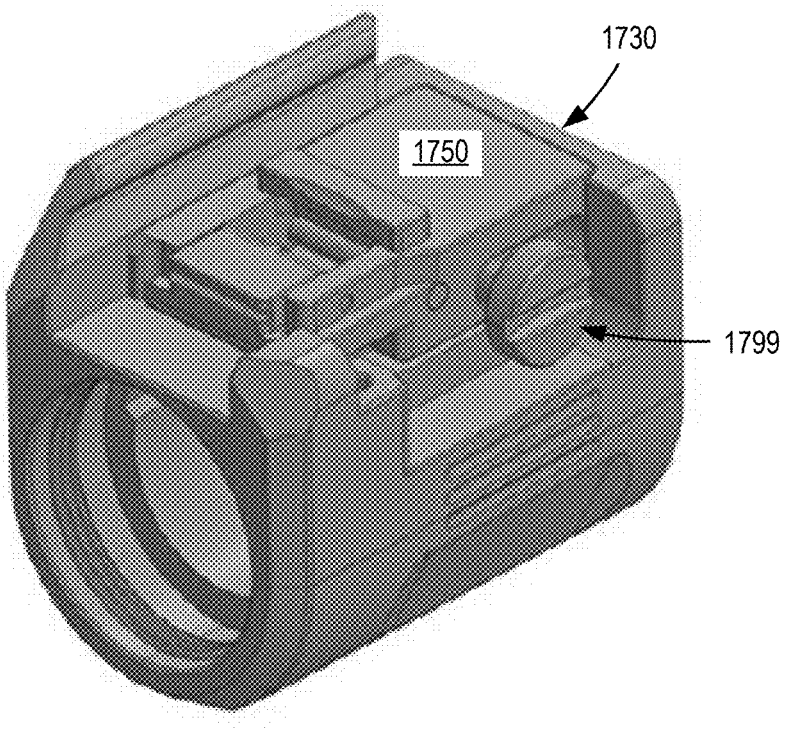
FIG. 48 depicts a view of the accessory body 1730 with the keying element 1750 in a third, rear position, in accordance with various embodiments.

FIG. 48 depicts a view of the accessory body 1730 with the keying element 1750 in a third, rear position, in accordance with various embodiments. The screw 1799 is inserted into the opening 1731*c* of FIG. 43.

FIG. 49 depicts an exploded bottom view of the keying element 1750 including a receptacle 1736 for a spring-loaded detent 1735, in accordance with various embodiments. The receptacle is on the bottom surface 1754. e.g., a surface that is on an opposite side of the keying element as the surface 1751 (FIG. 19). The spring-loaded detent may be held in the receptacle with a threaded fit or press fit, for example.

FIG. 50 depicts a bottom view of the keying element 1750 with the spring-loaded detent 1735 installed, in accordance with various embodiments. When the spring-loaded detent is installed in the underside of the keying element, a small ball 1735*a* protrudes slightly and can snap into one of the three indentations 1743 (FIG. 44) on the inside of the accessory body. The positions of these indentations match the spacing of the openings 1731 of the keying element to make it easier to adjust the forward-back location of the keying element before locking it in place. The spring loading advantageously provides a tactile and/or audible feedback when the ball snaps into one of the indentations.

Figure 51:
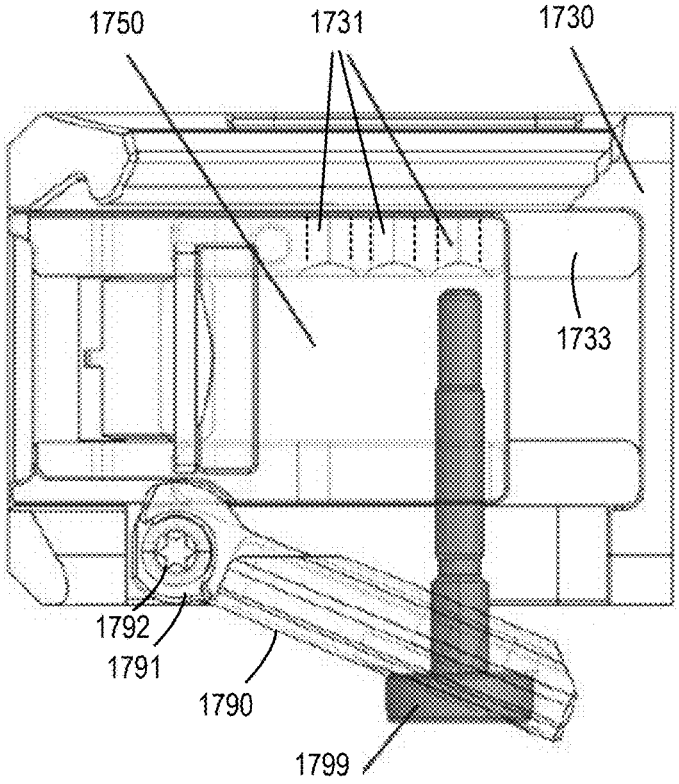
FIG. 51 depicts a top view of the accessory body 1730 and keying element 1750, consistent with FIG. 45, where the screw 1799 is in a position in which the keying element is not blocked from moving, and the rail clamp 1790 is in a first open position, in accordance with various embodiments.

FIG. 51 depicts a top view of the accessory body 1730 and keying element 1750, consistent with FIG. 45, where the screw 1799 is in a position in which the keying element is not blocked from moving, and the rail clamp 1790 is in a first open position, in accordance with various embodiments. As mentioned, the rail clamp includes a hinge 1791 and can rotate about a pin 1792 that is inserted into the accessory body.

The screw 1799 is unscrewed far enough to clear the openings 1731 that are shown by dotted lines. In this state, the keying element can slide forward and back into the different possible positions. The rail clamp 1790 is also swung open far enough that it could be mounted to or removed from the firearm rail.

Figure 52:
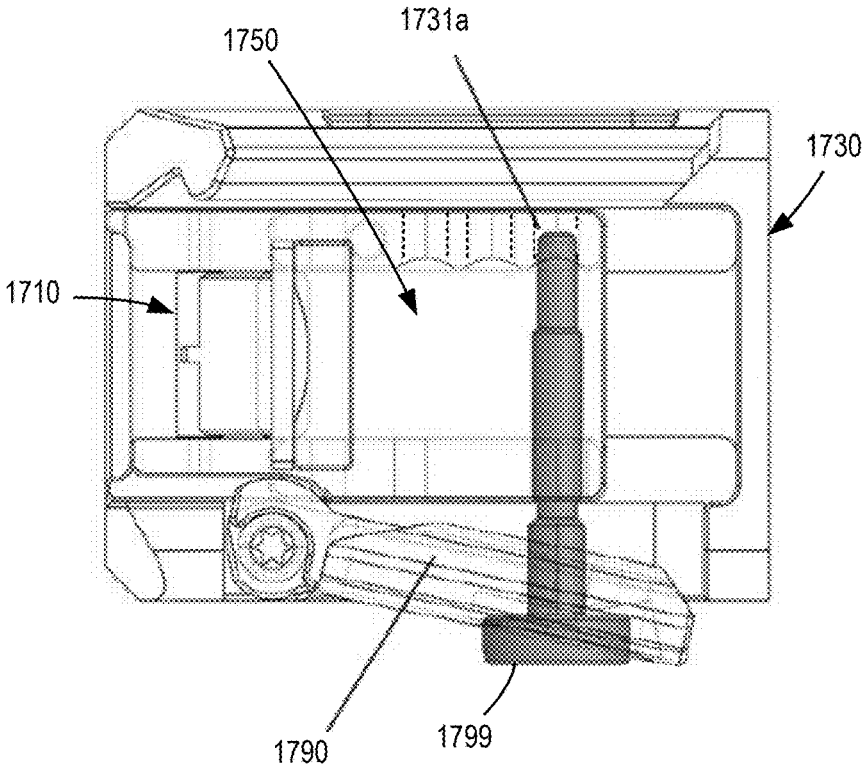
FIG. 52 depicts a top view of the accessory body 1730 and keying element 1750, where the screw 1799 is in a position in which the keying element is blocked from moving, and the rail clamp 1790 is in a second open position, in accordance with various embodiments.

FIG. 52 depicts a top view of the accessory body 1730 and keying element 1750, where the screw 1799 is in a position in which the keying element is blocked from moving, and the rail clamp 1790 is in a second open position, in accordance with various embodiments. The screw 1799 is inserted into the opening 1731*a*.

The screw is partially screwed in, far enough that it protrudes into one of the openings 1731*a*, locking the keying element in place and preventing forward and back movement. Though here the screw is still unscrewed enough that the rail clamp can be placed onto a firearm rail before fully tightening the screw. This highlights that if the light is mounted to a firearm and needs adjusting, the screw can be unscrewed enough to remove it from the firearm, but not so much as to have the keying element shift to another position, making it easier to mount the accessory body back onto the firearm rail. Note that the rail style selector 1710 can be flipped up (deployed) or down (non-deployed) at any time when the accessory body it is not already mounted to the firearm rail.

Figure 53:
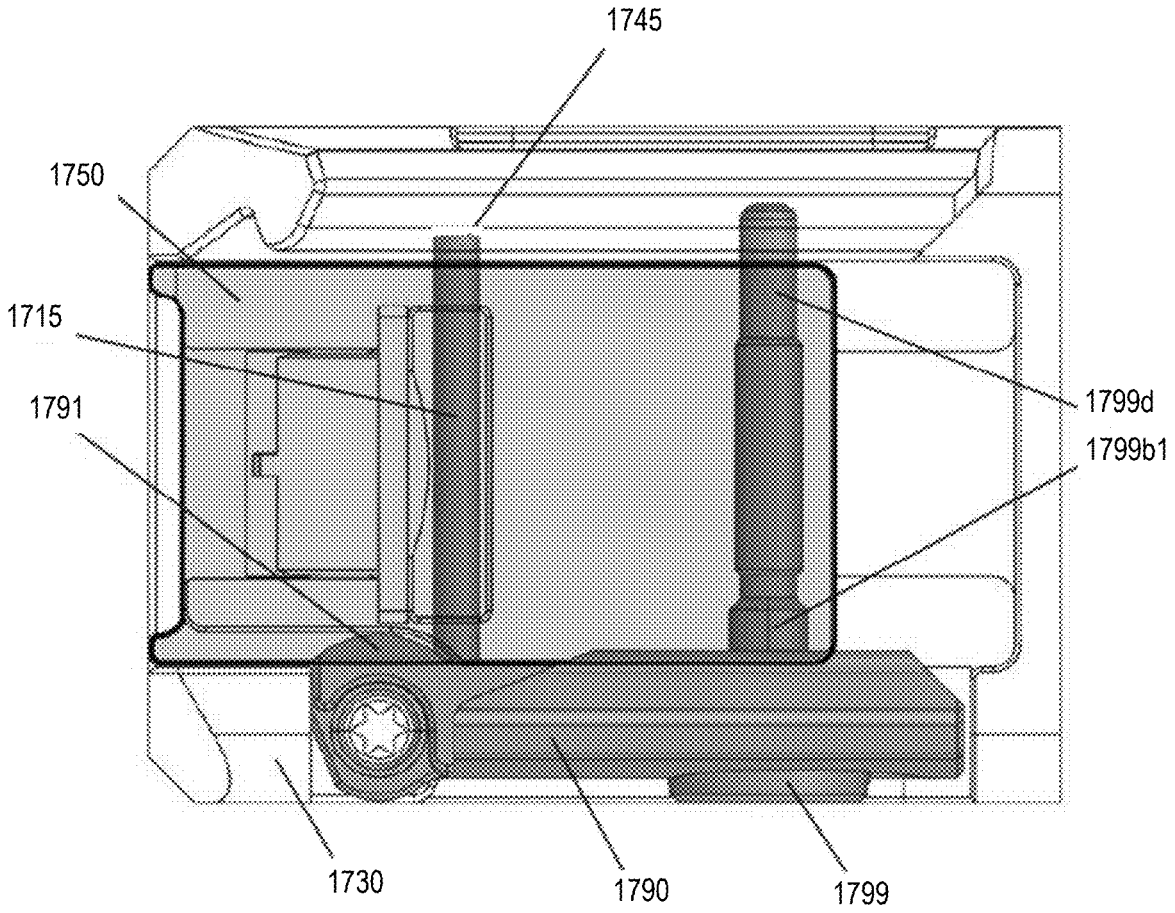
FIG. 53 depicts a top view of the accessory body 1730 and keying element 1750, where the screw 1799 is in a completely installed position in which the keying element is blocked from moving, and the rail clamp 1790 is in a closed position, in accordance with various embodiments.

FIG. 53 depicts a top view of the accessory body 1730 and keying element 1750, where the screw 1799 is in a completely installed position in which the keying element is blocked from moving, and the rail clamp 1790 is in a closed position, in accordance with various embodiments. This shows how the keying element 1750 is supported. The screw 1799 will secure both sides of the rear of the keying element using the locking pin 1715. This pin protrudes into the slot 1745 on one side of the front of the keying element, and a small section of the rail clamp 1790 overlaps the keying element to secure the other side of the front of the keying element. As a result, the keying element advantageously is not able to separate from the accessory body even under extreme recoil.

Some non-limiting examples of various embodiments are presented below.

Example 1 includes an accessory, comprising: an accessory body; a track on a surface of the accessory body, wherein the track extends in an axial direction of the accessory body; a keying element held in the track, wherein the keying element has a side edge with a plurality of notches, the keying element has a portion with a first height and a portion with a second height, greater than the first height; a rotatable position lock configured to engage any of the notches; a spring to bias the position lock; and first and second opposing clamping members.

Example 2 includes the accessory of Example 1, wherein the first clamping member is integral with the accessory body and the second clamping member is part of a rail clamp that is attachable to the accessory body.

Example 3 includes the accessory of Example 2, wherein the body comprises a cutout region for the rail clamp.

Example 4 includes the accessory of Example 2 or 3, wherein the rotatable position lock has a flat face adjacent to the rail clamp when the rail clamp is attached to the accessory body.

Example 5 includes the accessory of any one of Examples 1-4, wherein the rotatable position lock is configured to engage any of the notches by a pawl of the rotatable position lock.

Example 6 includes the accessory of Example 5, wherein the rotatable position lock provides at least one of a tactile or audible feedback when the pawl transitions from one of the notches to another of the notches as the keying element moves in the track.

Example 7 includes the accessory of any one of Examples 1-6, wherein the portion with the second height is shaped and sized to correspond to a channel of a firearm rail.

Example 8 includes the accessory of any one of Examples 1-7, wherein the portion with the second height comprises a keying element, and the keying element has a rectangular cross-section when viewed from a front and a side of the accessory body.

Example 9 includes the accessory of any one of Examples 1-8, wherein the first and second opposing clamping members are configured to clamp opposing edges of a rail of a firearm.

Example 10 includes the accessory of any one of Examples 1-9, wherein the track has a dovetailed cross-sectional shape.

Example 11 includes the accessory of any one of Examples 1-10, wherein the portion with the second height has a cutout for a screw that protrudes from portion with the second height in the axial direction and is partially encompassed within the cutout.

Example 12 includes the accessory of any one of Examples 1-11, wherein a front of the body is configured to attach to an optic.

Example 13 includes the accessory of any one of Examples 1-12, wherein the rotatable position lock is configured to engage any of the notches according to a position of the keying element in the track.

Example 14 includes the accessory of any one of Examples 1-13, wherein the spring comprises a coil having arms with respective tips seated in respective notches of the rotatable position lock.

Example 15 includes the accessory of any one of Examples 1-14, wherein the surface of the accessory body is a top surface, the accessory is configured to attach to a bottom side of a rail of a firearm, and the rail is underneath a barrel of the firearm.

Example 16 includes the accessory of any one of Examples 1-15, wherein the rotatable position lock is rotatable in a first direction when the keying element is moved aft in the track and rotatable in a second direction, opposite the first direction, when the keying element is moved forward in the track.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A firearm-mounted accessory, comprising:

an accessory body;

a keying element held in the accessory body, wherein the keying element comprises a surface and a keying member that extends from the surface; and a selector rotatably coupled to the keying element, wherein:

the selector is configured to rotate relative to the keying element between a deployed position and a non-deployed position;

in the deployed position, a portion of the selector extends past the surface, adjacent to the keying element, and a combined thickness of the portion of the selector and the keying element, and any gap between the portion of the selector and the keying element, corresponds to a first channel thickness of a mounting rail of a firearm; and in the non-deployed position, the portion of the selector does not extend past the surface, and a thickness of the keying element corresponds to a second channel thickness of a mounting rail of a firearm.

2. The firearm-mounted accessory of claim 1, wherein the keying element and the portion of the selector are rectangular.

3. The firearm-mounted accessory of claim 1, wherein the selector is L-shaped.

4. The firearm-mounted accessory of claim 1, wherein the selector is T-shaped.

5. The firearm-mounted accessory of claim 1, wherein:

the selector is coupled to a pin;

the pin comprises opposing ends held in opposing sides of the keying element; and the selector is rotatable about a longitudinal axis of the pin.

6. The firearm-mounted accessory of claim 1, wherein the first channel thickness is consistent with a Picatinny rail and the second channel thickness is consistent with a Universal rail.

7. The firearm-mounted accessory of claim 1, further comprising a track on the accessory body, wherein the keying element is held in the track and is moveable in an axial direction of the accessory body.

8. The firearm-mounted accessory of claim 1, further comprising a spring coupled to the selector to bias the selector toward the deployed position.

9. The firearm-mounted accessory of claim 1, wherein:

the keying element comprises opposing first and second sides;

the first side comprises an elongated opening;

and second side comprises a set of circular openings; and the accessory body comprises a threaded insert between the first and second sides.

10. The firearm-mounted accessory of claim 9, wherein the second side comprises cutouts for the circular openings, and the cutouts are configured to guide a tip of a screw.

11. The firearm-mounted accessory of claim 9, further comprising a screw, where the screw comprises:

a head;

an unthreaded shoulder adjacent to the head;

a threaded section adjacent to the unthreaded shoulder and configured to engage the threaded insert; and an unthreaded section at an end of the screw, adjacent to the threaded section, and configured to enter one of circular openings of the set of circular openings.

12. The firearm-mounted accessory of claim 1, wherein:

the keying element comprises opposing first and second sides that extend away from the surface;

the first and second sides each comprises an opening;

the accessory body comprises a slot that extends in an axial direction of the accessory body; and the keying element comprises a locking pin configured to slide transversely to the axial direction, through the openings, and into the slot.

13. The firearm-mounted accessory of claim 1, further comprising first and second clamping members, wherein the first clamping member is fixed relative to the accessory body and the second clamping member is pivotably attached to the accessory body.

14. The firearm-mounted accessory of claim 1, wherein:

the surface is a first surface;

the keying element further comprises a second surface on an opposing side of the keying element;

a spring-loaded detent is held in an opening in the second surface; and the accessory body comprises a set of indentations configured to engage the spring-loaded detent.

* * * * *